US011304496B2

(12) United States Patent
Yoshimura

(10) Patent No.: US 11,304,496 B2
(45) Date of Patent: Apr. 19, 2022

(54) LIPSTICK CONTAINER

(71) Applicant: YOSHINO KOGYOSHO CO., LTD., Tokyo (JP)

(72) Inventor: Kazuhisa Yoshimura, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 152 days.

(21) Appl. No.: 16/957,879

(22) PCT Filed: Dec. 27, 2018

(86) PCT No.: PCT/JP2018/047993

§ 371 (c)(1),
(2) Date: Jun. 25, 2020

(87) PCT Pub. No.: WO2019/131821

PCT Pub. Date: Jul. 4, 2019

(65) Prior Publication Data

US 2020/0337439 A1 Oct. 29, 2020

(30) Foreign Application Priority Data

Dec. 27, 2017 (JP) ..... JP2017-250775
Mar. 30, 2018 (JP) ..... JP2018-069860

(51) Int. Cl.
*A45D 40/04* (2006.01)
*A45D 40/06* (2006.01)
(Continued)

(52) U.S. Cl.
CPC ..... *A45D 40/04* (2013.01); *A45D 40/12* (2013.01); *A45D 40/06* (2013.01); *A45D 2040/0006* (2013.01)

(58) Field of Classification Search
CPC ..... A45D 40/04; A45D 40/06; A45D 40/02; A45D 40/12; A45D 40/20; A45D 2040/00;
(Continued)

(56) References Cited

U.S. PATENT DOCUMENTS 5,653,338 A * 8/1997 Tani ..... A45D 40/04 206/385
7,901,152 B2 * 3/2011 Hines ..... A47L 25/08 401/174

FOREIGN PATENT DOCUMENTS

JP S60-073418 U 5/1985
JP S64-000838 Y2 1/1989
(Continued)

OTHER PUBLICATIONS

Apr. 2, 2019 Search Report issued in International Patent Application No. PCT/JP2018/047993.
(Continued)

*Primary Examiner* — David J Walczak
(74) *Attorney, Agent, or Firm* — Oliff PLC

(57) ABSTRACT

A lipstick container, including: a container main body and a cap, in which the container main body includes a middle plate body provided with a screw pin, a middle cylindrical body, an inner cylindrical body in which a spiral groove into which the screw pin screwed is formed, and an outer cylindrical body, and one of the middle plate body and the inner cylindrical body moves up to a fixed position through rotation of the outer cylindrical body, and once the one reaches the fixed position, the other of the middle plate body and the inner cylindrical body moves up through rotation of the outer cylindrical body.

12 Claims, 18 Drawing Sheets

(51) Int. Cl.
*A45D 40/12* (2006.01)
*A45D 40/00* (2006.01)

(58) Field of Classification Search
CPC ..... A45D 40/00; A45D 2040/0025; A45D 2040/20; B65D 83/0005
USPC ... 401/64, 68, 69, 71, 75, 78, 172, 173, 174
See application file for complete search history.

(56) References Cited

FOREIGN PATENT DOCUMENTS

| | | | |
|---|---|---|---|
| JP | 2004-000343 | A | 1/2004 |
| JP | 2006-334368 | A | 12/2006 |
| JP | 2008-036372 | A | 2/2008 |
| JP | 2008-043590 | A | 2/2008 |
| JP | 2008-055025 | A | 3/2008 |
| WO | 2013/191523 | A2 | 12/2013 |

OTHER PUBLICATIONS

Aug. 12, 2021 Search Report issued in European Patent Application No. 18895191.7.

* cited by examiner

LIPSTICK CONTAINER

TECHNICAL FIELD

The present invention relates to a lipstick container which dispenses lipstick through a rotation operation, and particularly to a lipstick container in which soft lipstick is stored. Priority is claimed on Japanese Patent Application No. 2017-250775, filed Dec. 27, 2017, and Japanese Patent Application No. 2018-069860, filed Mar. 30, 2018, the contents of which are incorporated herein by reference.

BACKGROUND ART

A cylindrical dispensing container in which a rod-like cosmetic material such as lipstick is stored is known in the related art (for example, refer to Patent Document 1). The dispensing container includes a container main body and a cap mounted on the container main body. The container main body includes: a middle plate body in which the rod-like cosmetic material is stored; an inner cylindrical body (middle cylindrical body) which accommodates the middle plate body so as to be non-rotatable and vertically movable; and an outer cylindrical body which vertically moves the middle plate body by rotating along an outer circumferential surface of the inner cylindrical body. In this dispensing container, the outer cylindrical body is rotated while gripping the inner cylindrical body after removing a cap to make the rod-like cosmetic material appear from the inner cylindrical body due to vertical movement of the middle plate body to be used.

In addition, dispensing containers which prevent accidents such as breakage of rod-like cosmetics (lipstick) due to an excess amount of a rod-like cosmetic being dispensed are known in the related art (for example, refer to Patent Document 2). In this dispensing container, it is possible to determine an appropriate amount of dispensing of the rod-like cosmetics by pushing a cosmetics saucer (middle plate body) and a screw body of a screw cylinder upward by a specific amount using a spring when a cover (cap) is removed. In addition, in a case where a small-amount dispensing operation member is provided, the amount of rod-like cosmetics consumed can be simply replenished through a progressive operation of the small-amount dispensing operation member when the rod-like cosmetics are consumed.

CITATION LIST

Patent Document

[Patent Document 1]
Japanese Unexamined Patent Application, First Publication No. 2004-000343
[Patent Document 2]
Japanese Examined Utility Model Application, Second Publication No. S64-000838

SUMMARY OF INVENTION

Technical Problem

However, lipstick stored in a dispensing container has become softer in a recent trend. For this reason, in the dispensing container disclosed in the above-described Patent Document 1, a user may take too much of the lipstick out of the container so that a base of the lipstick sometimes breaks.

In addition, in the dispensing container disclosed in the above-described Patent Document 2, it is possible to prevent accidents such as breakage of the lipstick by suppressing the initial amount of lipstick dispensed such that it is sufficient for make-up while too much of the lipstick is not unnecessarily dispensed. However, it is impossible to adjust the initial dispensing amount of the lipstick.

The present invention solves such a problem, and an object of the present invention is to provide a lipstick container that can prevent lipstick from being broken by a user accidentally taking too much of the lipstick out at the start of use.

Solution to Problem

In order to solve the above-described problems, as a first aspect of the present invention, means of a lipstick container including: a container main body; and a cap mounted on the container main body, in which the container main body includes: a middle plate body in which lipstick is stored and is provided with a screw pin; a middle cylindrical body which guides the middle plate body such that the middle plate body can move vertically but cannot rotate; an inner cylindrical body in which a spiral groove into which the screw pin of the middle plate body is screwed is formed, and which vertically moves the middle plate body by rotating along an outer circumferential surface of the middle cylindrical body; and an outer cylindrical body, an inner circumferential surface of which is screwed into an outer circumferential surface of the inner cylindrical body, and one of the middle plate body and the inner cylindrical body is moved up to a fixed position through rotation of the outer cylindrical body, and once the one reaches the fixed position, the other of the middle plate body and the inner cylindrical body is moved up through rotation of the outer cylindrical body, is employed.

As a second aspect of the present invention, means of the lipstick container according to the above-described first aspect, in which an operation resistance between the outer cylindrical body and the inner cylindrical body screwed with each other is larger than that between the screw pin of the middle plate body and the spiral groove of the inner cylindrical body screwed with each other, is employed. As a third aspect of the present invention, means of the lipstick container according to the above-described first aspect, in which an operation resistance between the outer cylindrical body and the inner cylindrical body screwed with each other is smaller than that between the screw pin of the middle plate body and the spiral groove of the inner cylindrical body screwed with each other, is employed. As a fourth aspect of the present invention, means of the lipstick container according to the above-described first or second aspect, in which the inner cylindrical body includes a screw portion screwed into the outer cylindrical body and a pitch of the spiral groove is larger than that of the screw portion, is employed. As a fifth aspect of the present invention, means of the lipstick container according to the above-described first or third aspect, in which the inner cylindrical body includes a screw portion screwed into the outer cylindrical body and a pitch of the spiral groove is smaller than that of the screw portion, is employed. As a sixth aspect of the present invention, means of the lipstick container according to any one of the above-described first to fifth aspect, in which the inner cylindrical body has a planar portion provided at an upper end portion of the spiral groove, the planar portion along a direction orthogonal to a direction along a central axis of the inner cylindrical body, is employed. As a seventh aspect of the present invention, means of the lipstick container according to the above-described second, fourth, and sixth aspects, in which the inner cylindrical body includes a screw portion screwed into the outer cylindrical body and an interfering projection is formed in the screw portion, is employed. As an eighth aspect of the present invention, means of the lipstick container according to the above-described seventh aspect, in which a plurality of the interfering projections are formed intermittently, is employed. As a ninth aspect, means of the lipstick container according to the above-described seventh or eighth aspect, in which the interfering projection is formed in a valve actuator elastically deformable in a radial direction, is employed.

Advantageous Effects of Invention

The lipstick container of the present invention includes a middle plate body in which lipstick is stored and is provided with a screw pin, a middle cylindrical body which guides the middle plate body such that it can move vertically but cannot rotate, an inner cylindrical body in which a spiral groove into which the screw pin of the middle plate body is screwed is formed, and which vertically moves the middle plate body by rotating along an outer circumferential surface of the middle cylindrical body, and an outer cylindrical body which is used for an outer circumferential surface of the inner cylindrical body to be screwed into an inner circumferential surface thereof, and the lipstick is dispensed to a fixed position through rotation of the outer cylindrical body, and once the lipstick reaches the fixed position, the lipstick is gradually dispensed through rotation of the outer cylindrical body with a stronger force. This prevents a user from accidentally taking too much of the lipstick out at the start of use, thereby preventing the lipstick from breaking. In addition, an interfering projection is formed in a screw portion of an inner cylindrical body of the lipstick container of the present invention. For this reason, an operation resistance when the outer circumferential surface of the inner cylindrical body is screwed into the inner circumferential surface of the outer cylindrical body can be made stably larger than an operation resistance when the screw pin of the middle plate body is screwed into the spiral groove of the inner cylindrical body. As a result, in the case where the outer cylindrical body rotates at the start of use, the inner cylindrical body rotates integrally with the outer cylindrical body, and thereby the middle plate body can be moved up to a fixed position.

DESCRIPTION OF EMBODIMENTS

Figure 1:
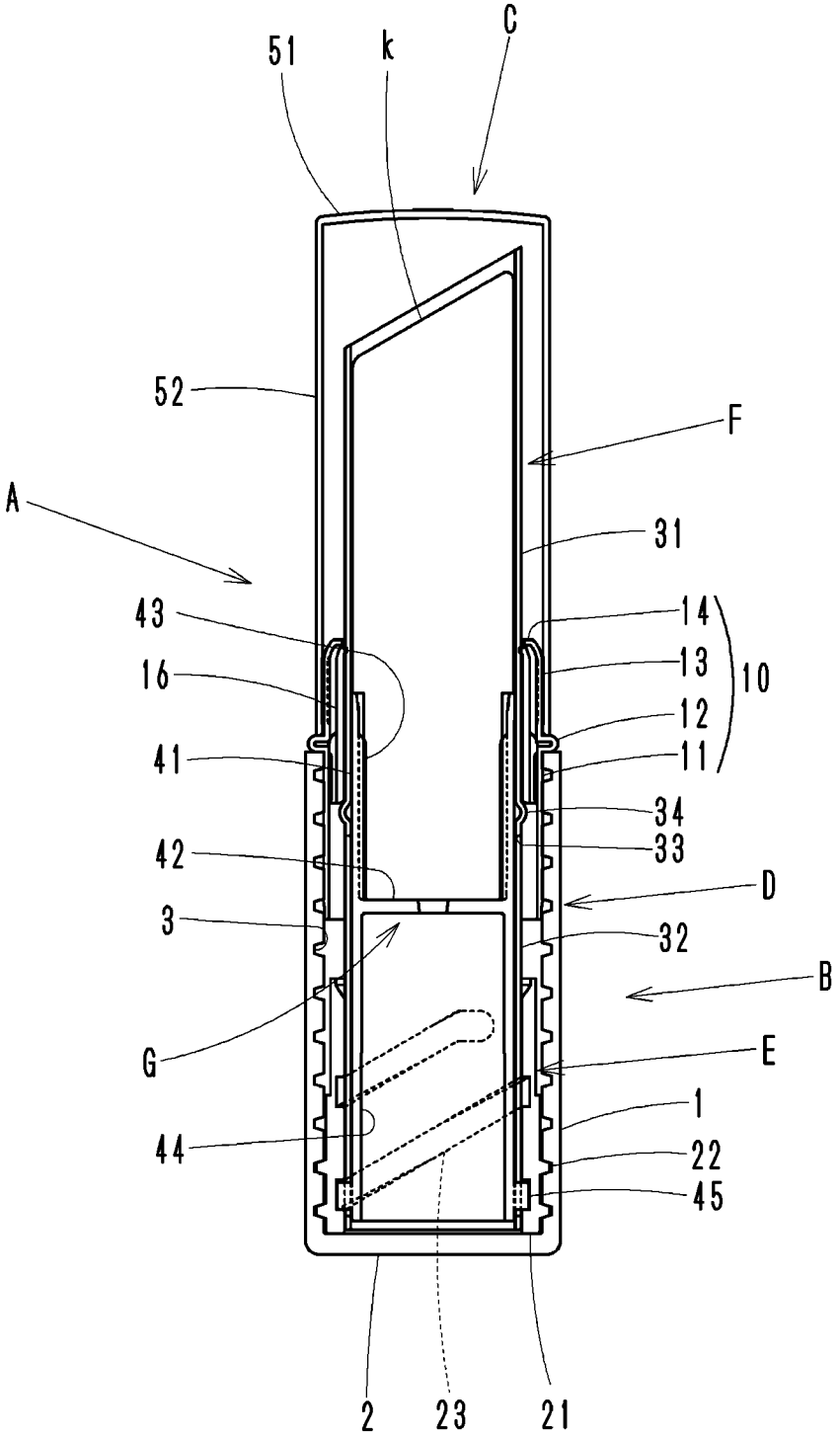
FIG. 1 is a cross-sectional side view showing a lipstick container according to a first embodiment of the present invention.

Next, a lipstick container of the present invention will be described with reference to the drawings showing each embodiment. The scope of the present invention is not limited to the following embodiments, and can be arbitrarily changed within the scope of the technical idea of the present invention. In the following description, the vertical direction in FIG. 1 is regarded as an "axial direction", the horizontal direction is regarded as a "horizontal direction" or a "direction orthogonal to the axial direction", the upward direction is regarded as being "upward", the downward direction is regarded as being "downward", the left direction is regarded as "forward", and the right direction is regarded as "backward". The axial direction is also a direction along a central axis of a container main body B (an outer cylindrical body D, an inner cylindrical body E, a middle cylindrical body F, and a middle plate body G) to be described below.

First Embodiment

A lipstick container A according to a first embodiment of the present invention will be described with reference to FIGS. 1 to 7. In FIG. 1, the lipstick container A includes: the container main body B that dispenses lipstick k through a rotation operation; and a cap C that is detachably mounted on the container main body B to cover an upper portion of the container main body B. The container main body B includes: the bottomed cylindrical-shaped outer cylindrical body D; the inner cylindrical body E of which an outer circumferential surface is screwed into an inner circumferential surface of the outer cylindrical body D; the middle cylindrical body F that rotatably supports the inner cylindrical body E; and the middle plate body G in which the lipstick k is stored and is accommodated in the middle cylindrical body F such that it can move vertically but cannot rotate.

Figure 2:
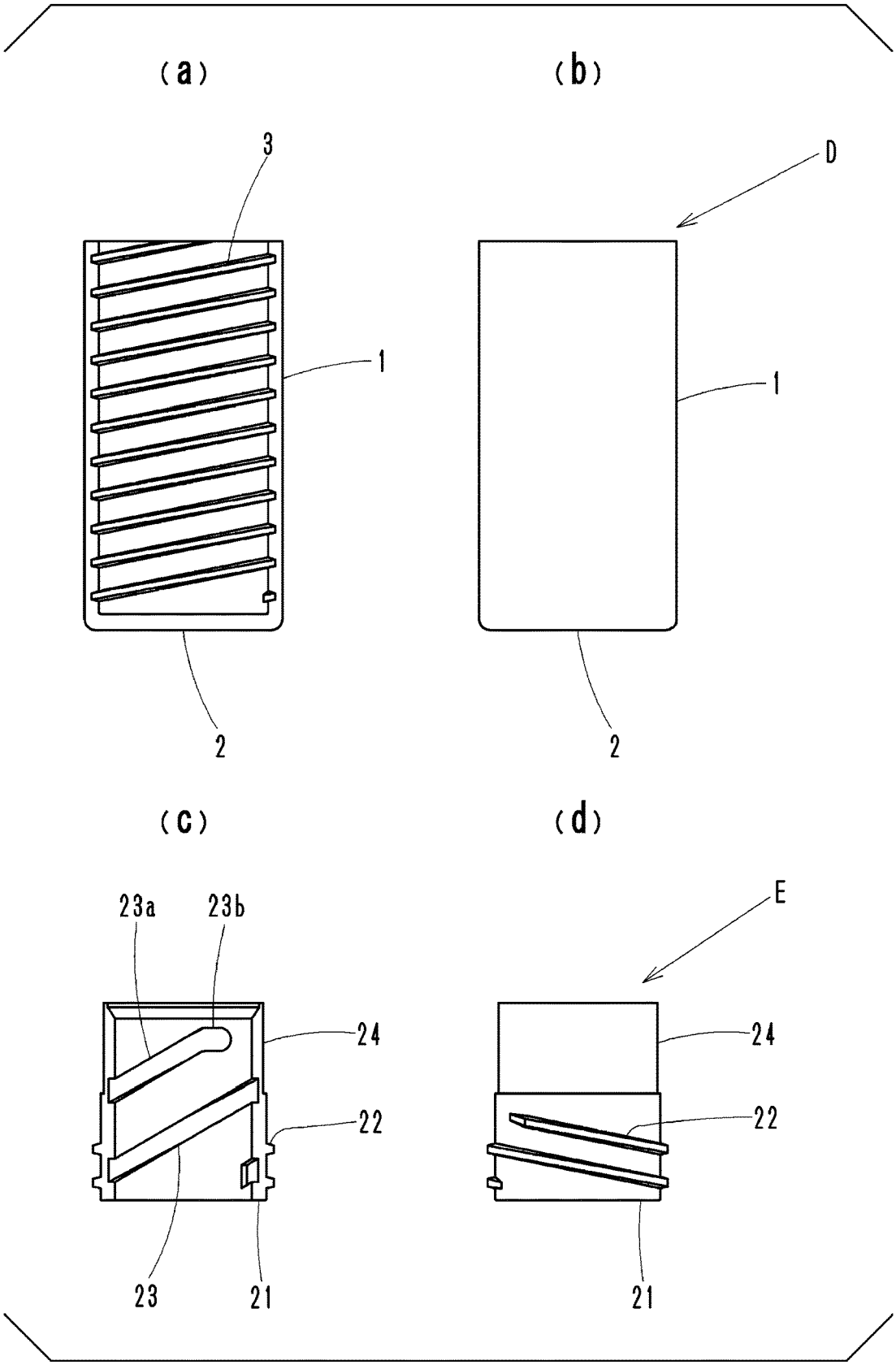
FIG. 2 is a view showing an outer cylindrical body and an inner cylindrical body of the lipstick container according to the first embodiment, in which (a) is a cross-sectional front view of the outer cylindrical body, (b) is a front view of the outer cylindrical body, (c) is a cross-sectional front view of the inner cylindrical body, and (d) is a front view of the inner cylindrical body.

As shown in (a) and (b) of FIG. 2, the outer cylindrical body D has a cylindrical outer circumferential wall 1 extending in the axial (vertical) direction and a disk-shaped bottom wall 2 extending inward from a lower end portion of the outer circumferential wall 1. A female screw portion 3 is spirally provided on an inner circumferential surface of the outer circumferential wall 1 to have a gentle inclination in a circumferential direction and a small pitch compared to a spiral groove 23 of the inner cylindrical body E to be described below.

As shown in FIG. 1, a mounting cylinder 10 is attached to an upper portion of the outer cylindrical body D. The mounting cylinder 10 includes: as shown in (a) of FIG. 4, an insertion cylinder portion 11 non-rotatably fitting and inserted into an upper portion of the inner circumferential surface of the outer circumferential wall 1 of the outer cylindrical body D; a flange portion 12 protruding outward from a substantially intermediate portion of the mounting cylinder 10; a cap-mounting portion 13 in which the cap C is attached to and detached from an upper portion of the flange portion 12; and an annular protrusion 14 of which the diameter is reduced from an upper end portion of the cap-mounting portion 13. A seal cylinder 16 is non-rotatably attached to the inside of the mounting cylinder 10. The seal cylinder 16 is made of an elastic material, and an upper end of an inner circumferential surface of the seal cylinder 16 airtightly and slidably comes into contact with an outer circumferential surface of the middle cylindrical body F.

As shown in (c) and (d) of FIG. 2, the inner cylindrical body E includes a cylindrical main body portion 21 having a lower height than the outer circumferential wall 1 of the outer cylindrical body D. That is, the main body portion 21 is shorter than the outer cylindrical body D in the axial direction. The main body portion 21 includes: a male screw portion 22 which is spirally provided on an outer circumferential surface of a lower portion of the main body portion 21 and screwed into the female screw portion 3 of the outer cylindrical body D; the spiral groove 23 which has two sections and formed on an inner circumferential surface of the main body portion 21; and a diameter-reduced upper portion 24 which is formed on an outer circumferential surface of an upper portion of the main body portion 21 and is provided for avoiding interference with the insertion cylinder portion 11 of the mounting cylinder 10 when the inner cylindrical body E is moved up along the inner circumferential surface of the outer cylindrical body D. The diameter-reduced upper portion 24 has a reduced diameter compared with the lower portion of the main body portion 21. In addition, the spiral groove 23 with two sections includes: an inclination portion 23*a* which is formed to have a larger pitch than the male screw portion 22 screwed into the female screw portion 3 of the outer cylindrical body D; and a horizontal portion 23*b* which is formed in an upper end portion of the inclination of the inclination portion 23*a*. The inclination portion 23*a* extends while being inclined in a circumferential direction of the main body portion 21. The upper end portion of the inclination is one end portion of the inclination portion 23*a* in the direction in which the inclination portion 23*a* extends, and is an end portion positioned further upward than the other end portion. The horizontal portion 23*b* is a planar portion along the horizontal direction, and is also a planar portion along the direction orthogonal to the direction along the central axis of the inner cylindrical body E and a planar portion along a direction parallel to the circumferential direction of the main body portion 21. In the present embodiment, the spiral groove 23 with two sections is formed to have a larger pitch than the male screw portion 22 screwed into the female screw portion 3 of the outer cylindrical body D, but the present invention is not limited thereto. In a case where an operation resistance when the male screw portion 22 of the inner cylindrical body E is screwed into the female screw portion 3 of the outer cylindrical body D is smaller than an operation resistance when a screw pin 45 of the middle plate body G is screwed into the spiral groove 23 of the inner cylindrical body E, the spiral groove 23 with two sections may be formed to have a smaller pitch than the male screw portion 22 screwed into the female screw portion 3 of the outer cylindrical body D as will be described below.

Figure 3:
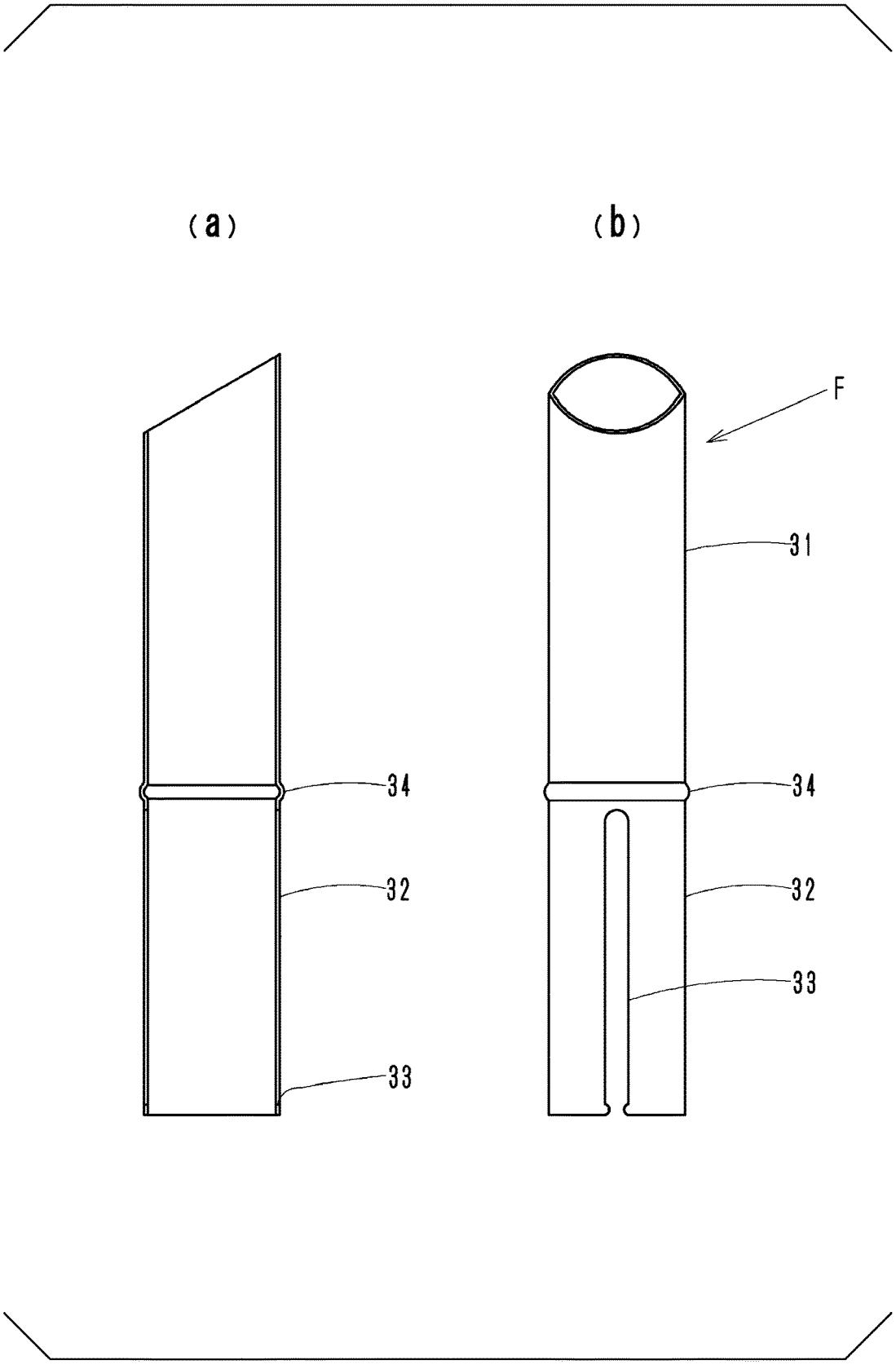
FIG. 3 is a view showing a middle cylindrical body of the lipstick container according to the first embodiment, in which (a) is a cross-sectional side view and (b) is a front view.

As shown in FIG. 1, the middle cylindrical body F is rotatably provided with respect to the inner cylindrical body E in a state of being prevented from slipping into the seal cylinder 16 using a locking protrusion 34 of an intermediate portion. The intermediate portion is a portion positioned substantially in the middle of the middle cylindrical body F in the axial direction, and the locking protrusion 34 is provided protruding radially outward from the intermediate portion. As shown in FIG. 3, the middle cylindrical body F includes: a storage cylinder portion 31 positioned at an upper portion of the locking protrusion 34 of the intermediate portion; and a guide cylinder portion 32 positioned at a lower portion of the locking protrusion 34. Two slit portions 33 which extend in the axial direction and are opposed to each other are formed in the guide cylinder portion 32. The two slit portions 33 are opposed to each other in the radial direction of the guide cylinder portion 32.

Figure 4:
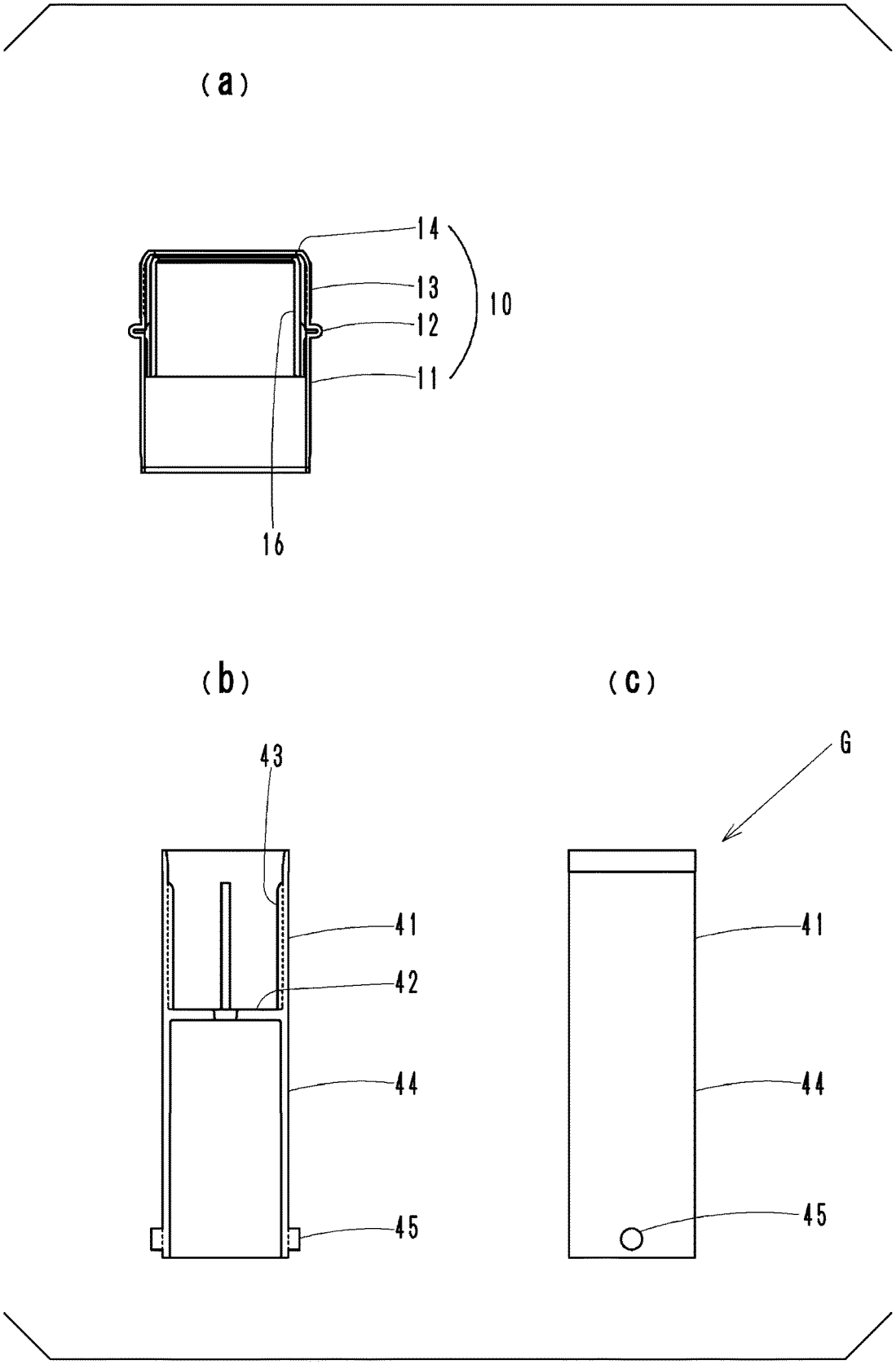
FIG. 4 is a view showing a mounting cylinder and a middle plate body of the lipstick container according to the first embodiment, in which (a) is a cross-sectional side view of the mounting cylinder, (b) is a cross-sectional side view of the middle plate body, and (c) is a front view of the middle plate body.

As shown in FIG. 1 and (b) and (c) of FIG. 4, the middle plate body G includes: a cylindrical plate side wall 41 which is positioned at an upper portion and in which the lipstick k is stored; a ring-shaped plate bottom wall 42 which is formed inward from a lower end portion of the plate side wall 41 and of which a central portion is open; a plurality of storage ribs 43 which are provided protruding in the radial direction from the inner circumferential surface of the plate side wall 41 in order to hold a lower portion of the lipstick k with the middle plate body G, and extend in the axial direction; and a cylindrical guide cylinder wall 44 which is suspended from a lower end portion of the plate side wall 41 and of which an outer circumferential surface comes into slidable contact with an inner circumferential surface of the guide cylinder portion 32 of the middle cylindrical body F.

Furthermore, two screw pins 45 which penetrate the slit portions 33 formed in the guide cylinder portion 32 of the middle cylindrical body F and are screwed into the spiral groove 23 of the inner cylindrical body E are provided protruding on an outer circumferential surface of a lower end portion of the guide cylinder wall 44. The screw pins 45 are provided protruding radially outward from the guide cylinder wall 44. Here, one of the operation resistance when the male screw portion 22 of the inner cylindrical body E is screwed into the female screw portion 3 of the outer cylindrical body D and the operation resistance when the screw pins 45 of the middle plate body G are screwed into the spiral groove 23 of the inner cylindrical body E is set to be larger than the other.

As shown in FIG. 1, the cap C includes: a disk-shaped top wall 51 having a swelling toward the center from the periphery; and a disk-shaped side circumferential wall 52 suspended from an outer edge of the top wall 51. The side circumferential wall 52 is formed so that an inner circumferential surface of the side circumferential wall comes into contact with an outer circumferential surface of the cap-mounting portion 13 of the mounting cylinder 10 to have an inner diameter fitting into the mounting cylinder 10.

Next, a method of use and effects of the present embodiment will be described with reference to the drawings. When using the lipstick k, the cap C is removed from the container main body B of the lipstick container A shown in FIG. 1, and then, the outer circumferential wall 1 of the outer cylindrical body D is rotated clockwise with respect to the middle cylindrical body F (when the outer cylindrical body D is seen from below in the axial direction) while gripping the storage cylinder portion 31 of the middle cylindrical body F with fingers. At this time, in a case where the operation resistance when the female screw portion 3 of the outer cylindrical body D is screwed into the male screw portion 22 of the inner cylindrical body E is set to be larger than the operation resistance when the screw pins 45 of the middle plate body G are screwed into the spiral groove 23 of the inner cylindrical body E, the inner cylindrical body E rotates integrally with the outer cylindrical body D at the start of use.

In the case where the inner cylindrical body E rotates integrally with the outer cylindrical body D, the screw pins 45 screwed into the spiral groove 23 of the inner cylindrical body E starts to move up along the slit portions 33 of the middle cylindrical body F and the middle plate body G also starts to move up. Then, in a case where the screw pins 45 of the middle plate body G are moved up to the upper end portion of the inclination of the inclination portion 23*a* of the spiral groove 23 accompanied by the rotation of the inner cylindrical body E as shown in (b) of FIG. 5, the middle plate body G stops moving up at the fixed position due to the horizontal portion 23*b* continuing from the inclination portion 23*a*. Accordingly, a distal portion of the lipstick k protrudes from the storage cylinder portion 31 of the middle cylindrical body F as shown in (a) of FIG. 5, and the lipstick k can be used. The horizontal portion 23*b* of the spiral groove 23 may form an opening portion penetrating the main body portion 21 of the inner cylindrical body E.

Figure 5:
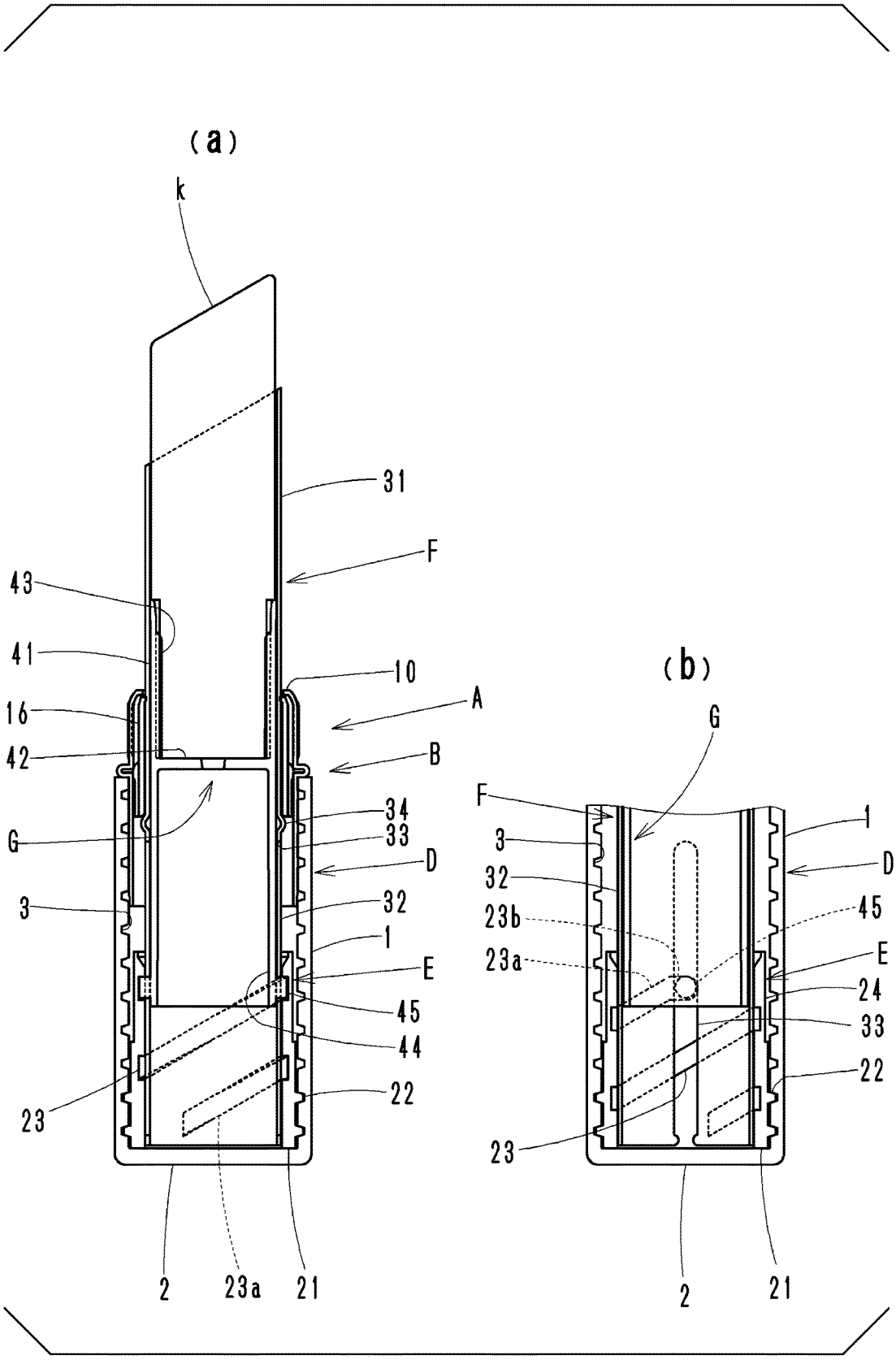
FIG. 5 is a view showing a state of the lipstick container according to the first embodiment when lipstick has been dispensed to a fixed position, in which (a) is a cross-sectional side view and (b) is a cross-sectional front view.

In this manner, even if a user accidentally rotates the outer cylindrical body D at once when using the lipstick container A, since the pitch of the inclination portion 23*a* of the spiral groove 23 of the inner cylindrical body E is large in the initial state (at the start of use) shown in FIG. 1 and (a) and (b) of FIG. 5, the middle plate body G in which the lipstick k is stored rises to the position shown in (a) and (b) of FIG. 5 without stress. However, it is necessary to rotate the outer cylindrical body D with a larger force than that in the initial state to raise the inner cylindrical body E with respect to the outer cylindrical body D to further raise the middle plate body G. Therefore, it is possible to prevent too much of the lipstick k from being taken out of the storage cylinder portion 31 of the middle cylindrical body F and breaking. As described above, it is possible to set the maximum dispensing amount of lipstick k in the initial state by adjusting the length (height) of the spiral groove 23 in the axial direction which is formed on the inner circumferential surface of the main body portion 21 of the inner cylindrical body E shown in (c) of FIG. 2. The size of the pitch of the spiral groove 23 formed in the inner cylindrical body E or the female screw portion 3 formed in the outer cylindrical body D can be freely set, and therefore, can be appropriately selected depending on the amount (length) of lipstick k to be dispensed.

Next, when returning the lipstick container from the state shown in (a) and (b) of FIG. 5 to a state in which the distal portion of the lipstick k is stored in the storage cylinder portion 31 of the middle cylindrical body F after the use of the lipstick k, the outer circumferential wall 1 of the outer cylindrical body D is rotated counterclockwise with respect to the middle cylindrical body F (when the outer cylindrical body D is seen from below in the axial direction). At this time, the inner cylindrical body E does not move up on the inner circumferential surface of the outer cylindrical body D. That is, the inner cylindrical body E comes into contact with a bottom wall 2 of the outer cylindrical body D. For this reason, the inner cylindrical body E screwed into the outer cylindrical body D using the female screw portion 3 of the outer cylindrical body and the male screw portion 22 rotates integrally with the outer cylindrical body D. Then, since the operation resistance when the screw pins 45 of the middle plate body G are screwed into the spiral groove 23 of the inner cylindrical body E is small, the middle plate body G is smoothly lowered along the slit portions 33 of the middle cylindrical body F, thereby returning the distal portion of the lipstick k into the storage cylinder portion 31.

Next, a case where the lipstick k is consumed as shown in (a) of FIG. 6 by dispensing the lipstick k from the middle cylindrical body F and using the lipstick will be described. In this case, even if the outer circumferential wall 1 of the outer cylindrical body D is tried to be rotated clockwise with respect to the middle cylindrical body F (when the outer cylindrical body D is seen from below in the axial direction) while gripping the storage cylinder portion 31 of the middle cylindrical body F with fingers, the screw pins 45 of the middle plate body G are engaged with the horizontal portion 23*b* which is the upper end portion of the spiral groove 23 in the inner cylindrical body E. For this reason, even if the outer cylindrical body D is rotated with the same force as that in the initial state, the inner cylindrical body E cannot be rotated any more. However, in a case where the outer cylindrical body D is rotated with a larger force than that in the initial state, the inner cylindrical body E gradually moves up while the rotation is restricted along the inner circumferential surface of the outer cylindrical body D through the rotation of the female screw portion 3 of the outer cylindrical body D into which the male screw portion 22 is screwed. That is, the inner cylindrical body E separates from the bottom wall 2 of the outer cylindrical body D.

Figure 6:
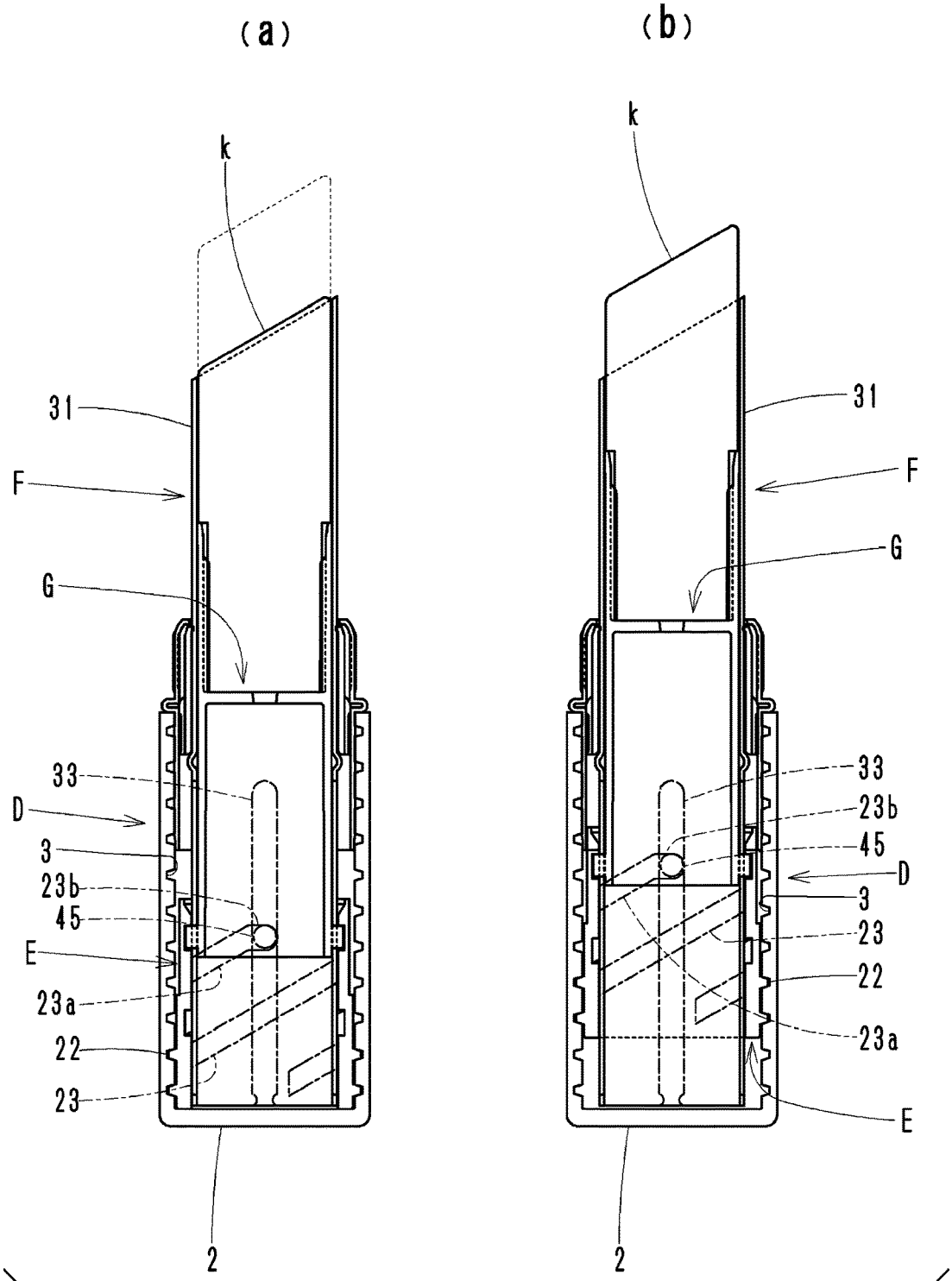
FIG. 6 is a view showing a state of the lipstick container according to the first embodiment when in use, in which (a) is a cross-sectional side view when the lipstick has been consumed at the fixed position and (b) is a cross-sectional side view when the lipstick has been dispensed from the state of (a).
Figure 7:
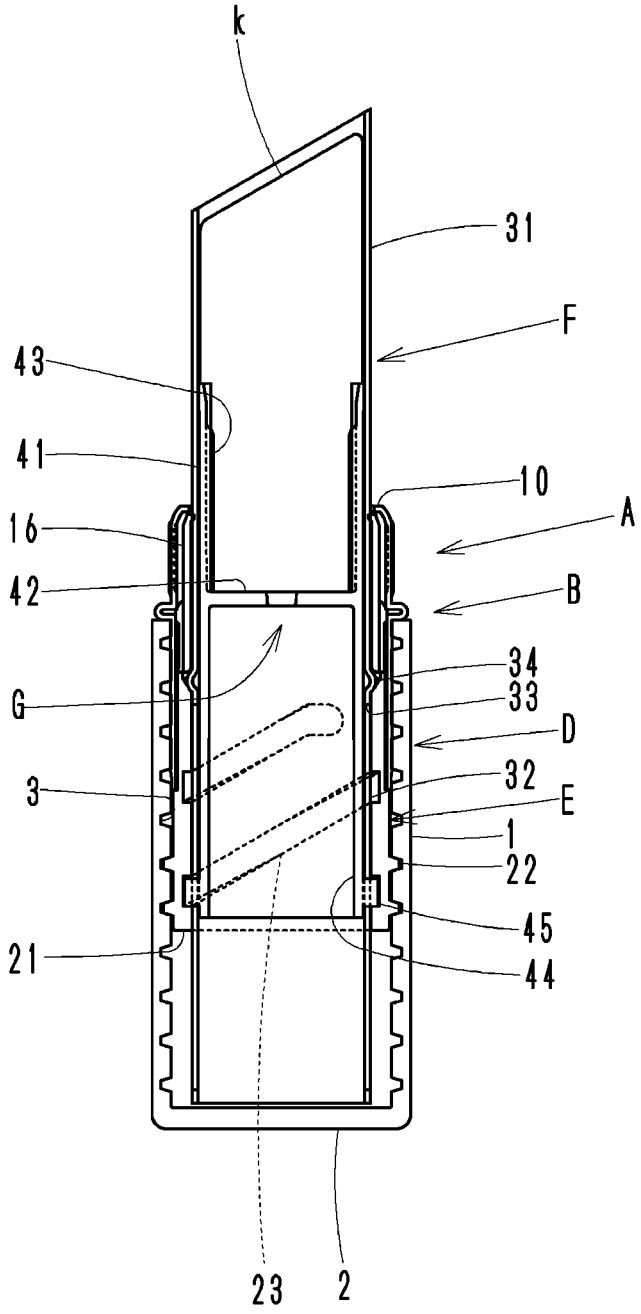
FIG. 7 is a cross-sectional side view of the lipstick container according to the first embodiment when a distal portion of the lipstick is made to return into a container main body in a state where the inner cylindrical body has been moved up.

At the same time, the middle plate body G in which the lipstick k is stored moves up along the slit portions 33 of the middle cylindrical body F as shown in (b) of FIG. 6. Accordingly, the distal portion of the lipstick k protrudes from the storage cylinder portion 31 of the middle cylindrical body F, and the lipstick k can be used. Furthermore, in a case where the lipstick k is consumed due to use of the lipstick k, the inner cylindrical body E can be moved up to an upper limit position at which the upper end of the inner cylindrical body E abuts on the locking protrusion 34 of the middle cylindrical body F as shown in FIG. 7 by further rotating the outer cylindrical body D as described in (a) and (b) of FIG. 6.

When returning the lipstick container from the state shown in (b) of FIG. 6 to a state in which the distal portion of the lipstick k is stored in the storage cylinder portion 31 of the middle cylindrical body F after the use of the lipstick k, the outer circumferential wall 1 of the outer cylindrical body D is rotated counterclockwise with respect to the middle cylindrical body F (when the outer cylindrical body D is seen from below in the axial direction). At this time, since the rotation of the inner cylindrical body E is not restricted by the screw pins 45 of the middle plate body G, the inner cylindrical body E screwed into the outer cylindrical body D using the female screw portion 3 of the outer cylindrical body and the male screw portion 22 rotates integrally with the outer cylindrical body D. For this reason, the inner cylindrical body E hardly moves down along the inner circumferential surface of the outer cylindrical body D. Then, since the screw pins 45 of the middle plate body G are screwed into the spiral groove 23 of the inner cylindrical body E so that the operation resistance when the screw pins 45 of the middle plate body G are screwed into the spiral groove 23 of the inner cylindrical body E is smaller than the operation resistance when the male screw portion 22 of the inner cylindrical body E is screwed into the female screw portion 3 of the outer cylindrical body D, the middle plate body G is smoothly lowered along the slit portions 33 of the middle cylindrical body F, thereby returning the distal portion of the lipstick k into the storage cylinder portion 31.

Modification Example

Next, a modification example of the first embodiment according to the present invention will be described with reference to FIG. 8 and (a) and (b) of FIG. 9. The case where the operation resistance when the male screw portion 22 of the inner cylindrical body E is screwed into the female screw portion 3 of the outer cylindrical body D is set to be smaller than the operation resistance when the screw pins 45 of the middle plate body G are screwed into the spiral groove 23 of the inner cylindrical body E will be described as the modification example of the first embodiment. In such a case, if the outer circumferential wall 1 of the outer cylindrical body D is rotated clockwise with respect to the middle cylindrical body F (when the outer cylindrical body D is seen from below in the axial direction) while gripping the storage cylinder portion 31 of the middle cylindrical body F with fingers after the cap C is removed from the container main body B of the lipstick container A shown in FIG. 1, the inner cylindrical body E moves up along the inner circumferential surface of the outer cylindrical body D while the rotation of the inner cylindrical body is restricted by the rotation of the female screw portion 3 of the outer cylindrical body D into which the male screw portion 22 is screwed.

Figure 8:
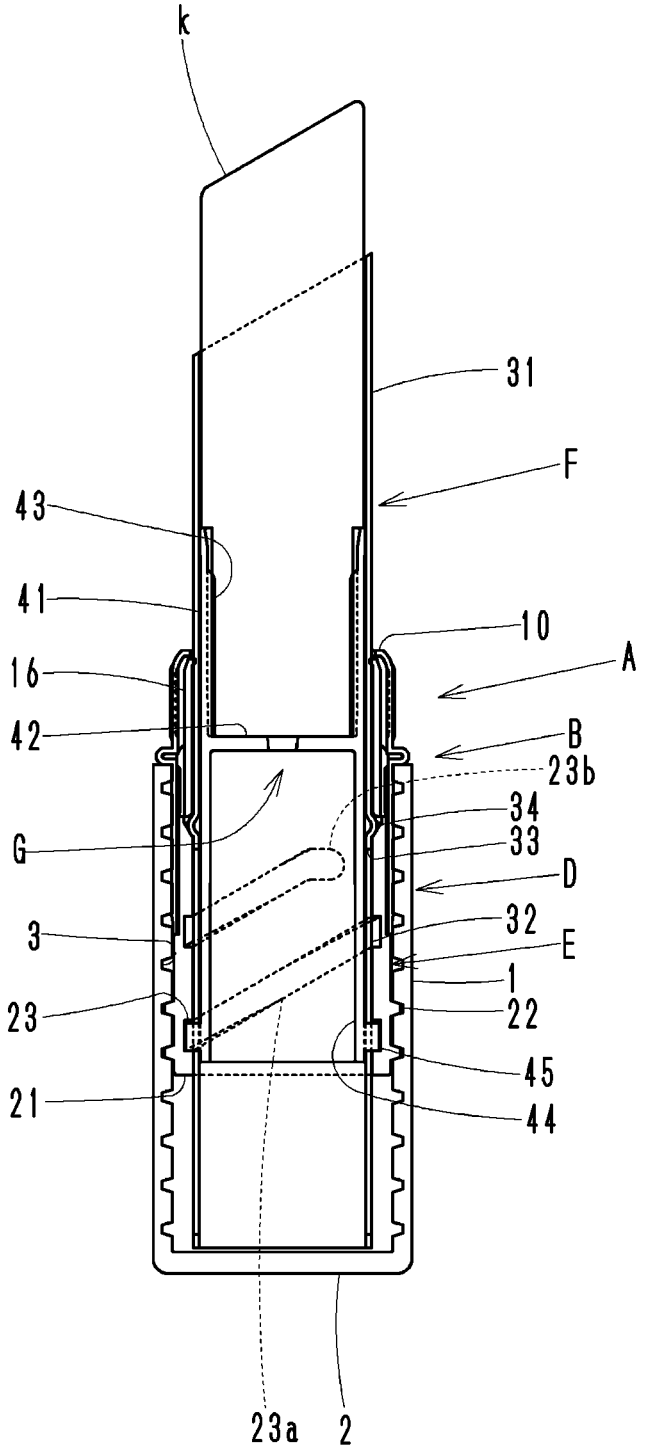
FIG. 8 is a cross-sectional side view showing a state of a lipstick container of a modification example of the first embodiment when lipstick has been dispensed to a fixed position.
Figure 9:
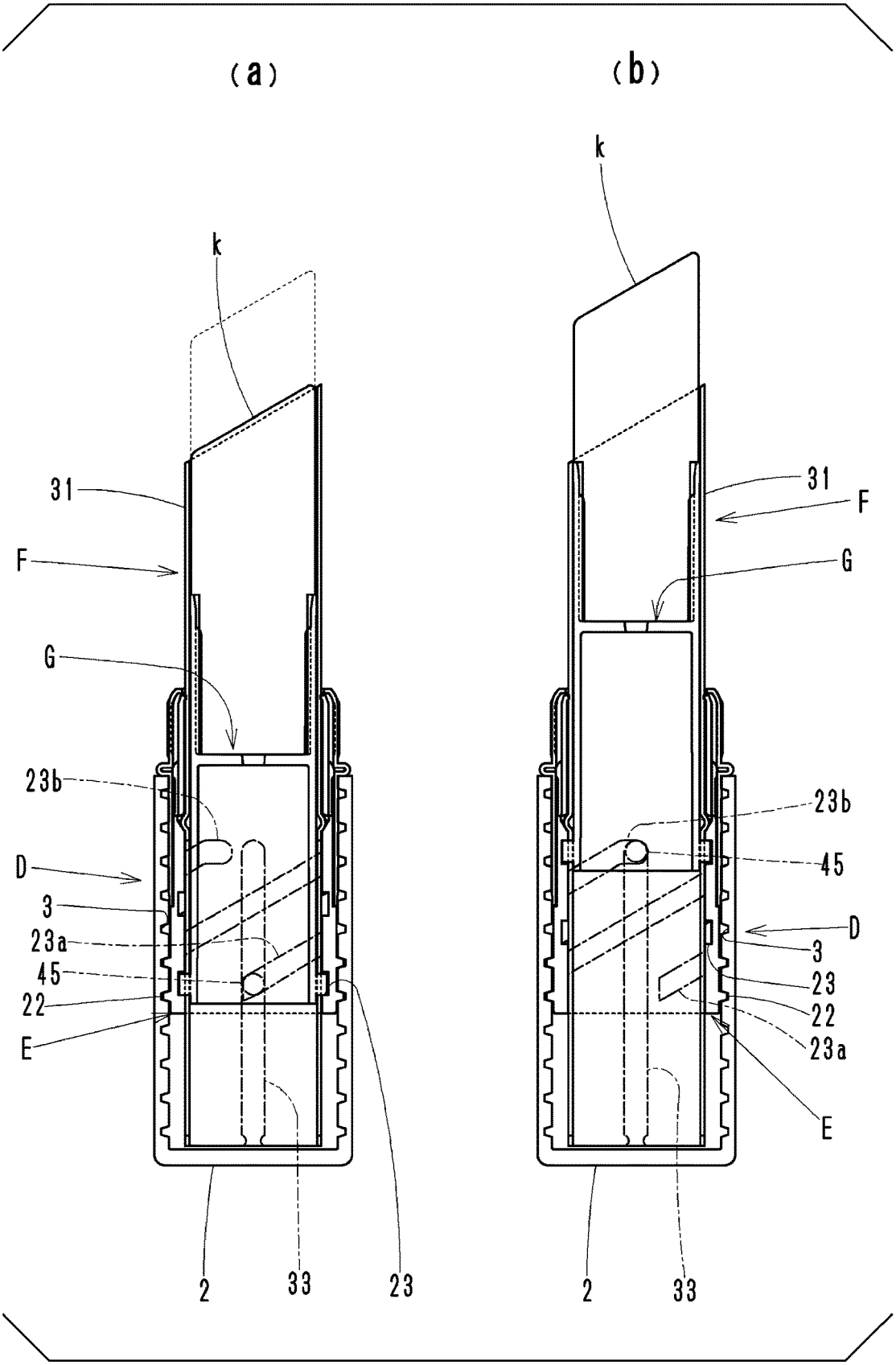
FIG. 9 is a view showing a state of the lipstick container of the modification example of the first embodiment when in use, in which (a) is a cross-sectional side view when the lipstick has been consumed at the fixed position and (b) is a cross-sectional side view when the lipstick has been dispensed from the state of (a).

At the same time, in a case where the middle plate body G in which the lipstick k is stored moves up along the middle cylindrical body F, the distal portion of the lipstick k protrudes from the storage cylinder portion 31 of the middle cylindrical body F as shown in FIG. 8, and the lipstick k can be used. Furthermore, in a case where the lipstick k is consumed as shown in (a) of FIG. 9 due to use of the lipstick k, the screw pins 45 of the middle plate body G can be moved up to the upper end portion of the inclination of the inclination portion 23*a* of the spiral groove 23 accompanied by the rotation of the inner cylindrical body E as shown in (b) of FIG. 9 by further rotating the outer cylindrical body D.

Second Embodiment

Next, a second embodiment according to the present invention will be described with reference to FIGS. 10 to 13 and 17. A case where the configurations of the outer cylindrical body D and the inner cylindrical body E of the first embodiment are changed in order to stabilize the operation resistance of the inner cylindrical body E with respect to the outer cylindrical body D so that the middle plate body G reliably moves up first if the lipstick container A is rotated at the start of use, and then, the inner cylindrical body E moves up as necessary will be described as the second embodiment. Hereinafter, the same constituent parts as those of the first embodiment are denoted by the same reference numerals, changed portions of the outer cylindrical body D and the inner cylindrical body E are denoted by new reference numerals, and the description will be focused on the differences.

Figure 10:
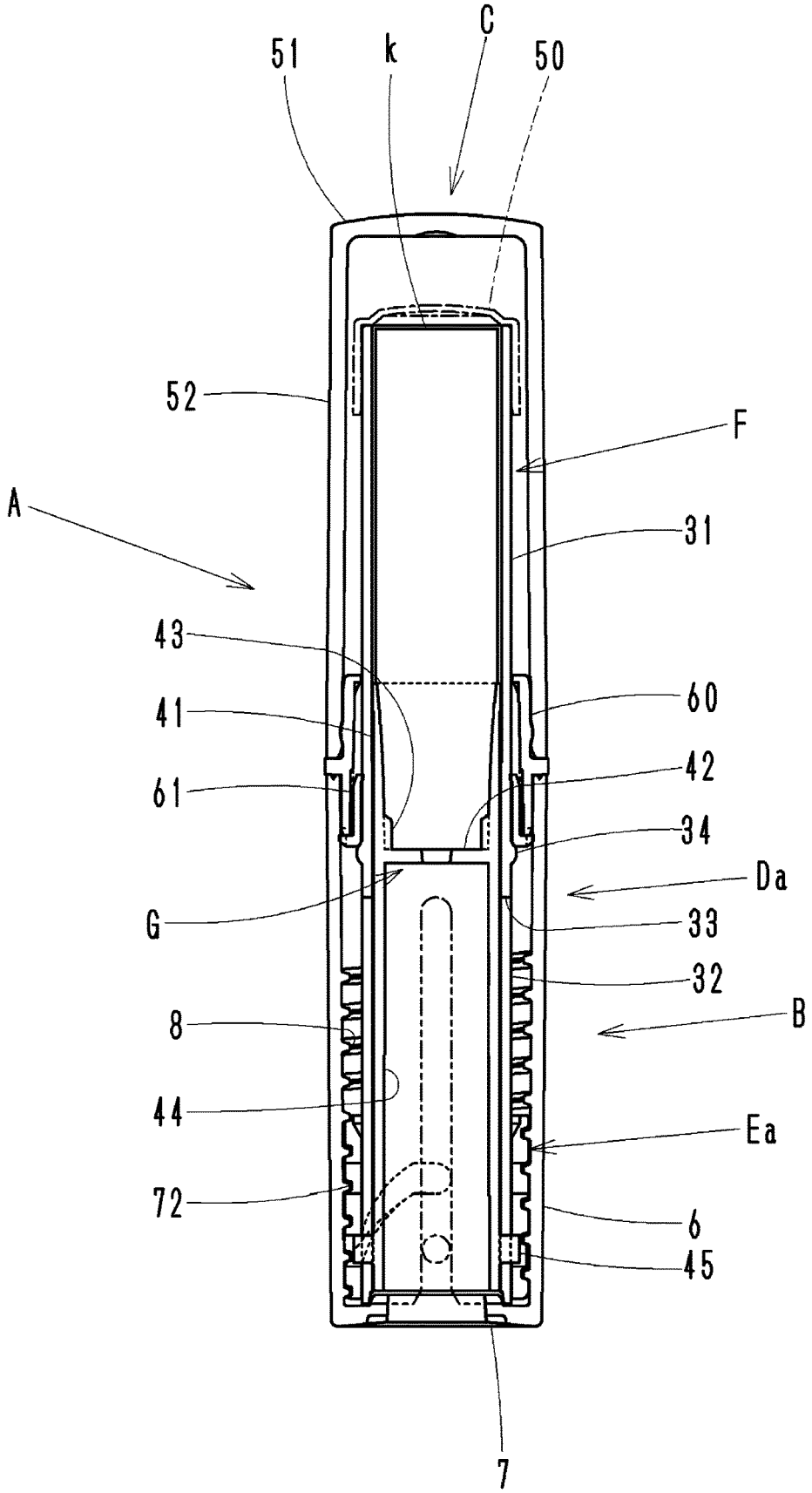
FIG. 10 is a cross-sectional side view showing a lipstick container according to a second embodiment of the present invention.

In FIG. 10, the lipstick container A includes: a container main body B that dispenses lipstick k through a rotation operation; and a cap C that is detachably mounted on the container main body B to cover an upper portion of the container main body B. The container main body B includes: a bottomed cylindrical-shaped outer cylindrical body Da; an inner cylindrical body Ea of which an outer circumferential surface is screwed into an inner circumferential surface of the outer cylindrical body Da; a middle cylindrical body F that rotatably supports the inner cylindrical body Ea; and a middle plate body G in which the lipstick k is stored and is accommodated in the middle cylindrical body F such that it can move vertically but cannot rotate.

Figure 11:
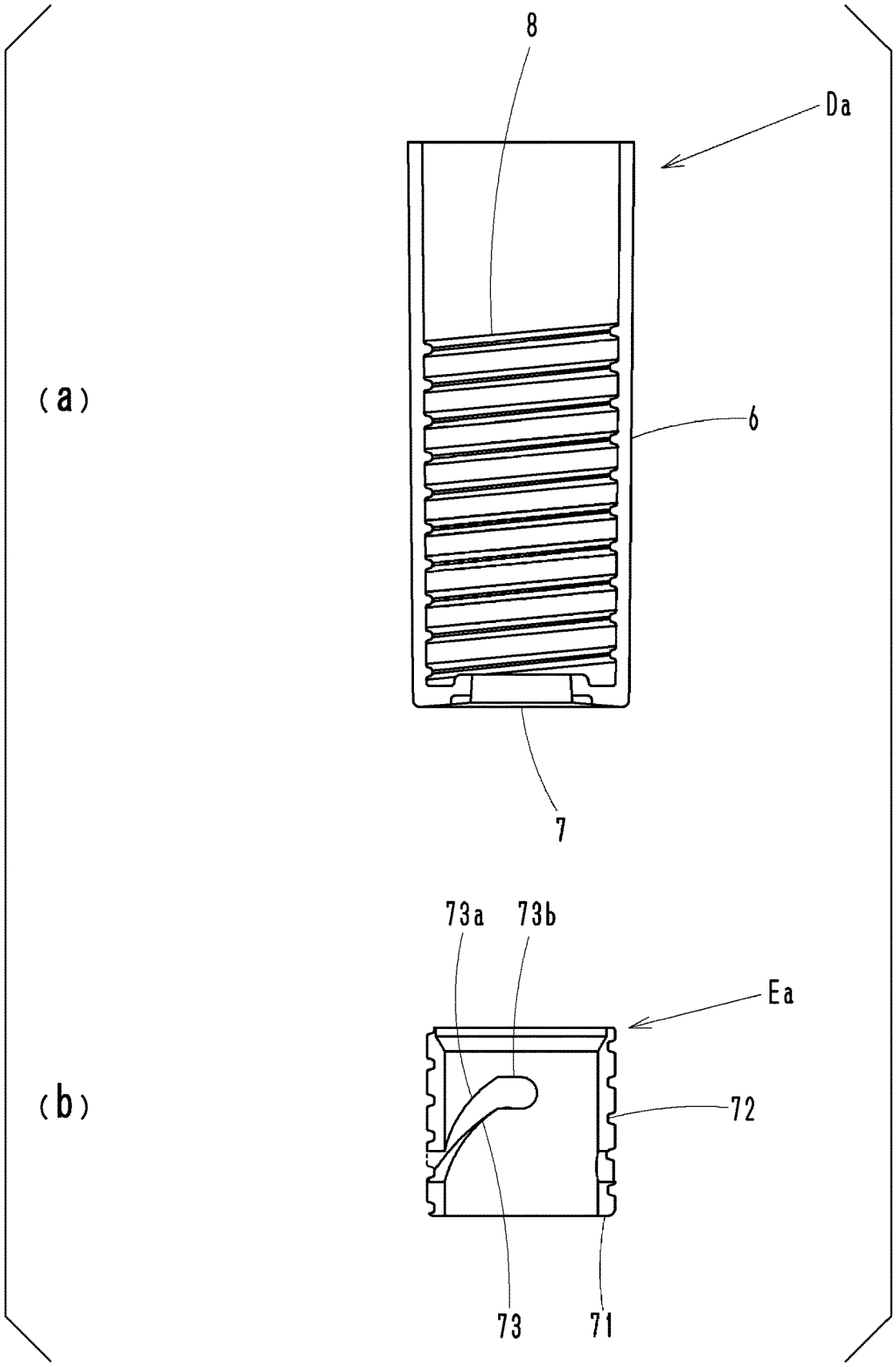
FIG. 11 is a view showing an outer cylindrical body and an inner cylindrical body according to the second embodiment, in which (a) is a cross-sectional front view of the outer cylindrical body and (b) is a cross-sectional front view of the inner cylindrical body.

As shown in (a) of FIG. 11, the outer cylindrical body Da includes: a cylindrical-shaped outer circumferential wall 6 extending in an axial direction; and a bottom wall 7 extending inward from a lower end portion of the outer circumferential wall 6. A screw thread portion 8 is formed on an inner circumferential surface of the outer circumferential wall 6 from the lower end portion to the middle of an upper portion of the lower end portion to be screwed into a screw groove portion 72 of the inner cylindrical body Ea to be described below. As shown in FIG. 10, a mounting cylinder 60 is attached to an upper portion of the outer cylindrical body D. A seal cylinder 61 is non-rotatably attached to the inside of the mounting cylinder 60. The seal cylinder 61 is made of an elastic material, and an upper end of an inner circumferential surface of the seal cylinder 61 airtightly and slidably comes into contact with an outer circumferential surface of the middle cylindrical body F.

As shown in (b) of FIG. 11, the inner cylindrical body Ea includes: a cylindrical main body portion 71 having a lower height than the outer circumferential wall 6 of the outer cylindrical body Da; the screw groove portion 72 (screw portion) which is spirally provided from a lower end portion of an outer circumferential surface of the main body portion 71 to an upper end portion and into which the screw thread portion 8 of the outer cylindrical body Da is screwed; and a spiral groove 73 which has two sections and penetrates the main body portion 71 in a radial direction. In addition, the spiral groove 73 with two sections includes: an inclination portion 73*a* which is formed to have a larger pitch than the screw groove portion 72 into which the screw thread portion 8 of the outer cylindrical body Da is screwed; and a horizontal portion 73*b* which is formed in an upper end portion of the inclination of the inclination portion 73*a*. The horizontal portion 73*b* is a planar portion along the horizontal direction, and is also a planar portion along the direction orthogonal to the direction along the central axis of the inner cylindrical body Ea and a planar portion along a direction parallel to the circumferential direction of the main body portion 71.

Figure 12:
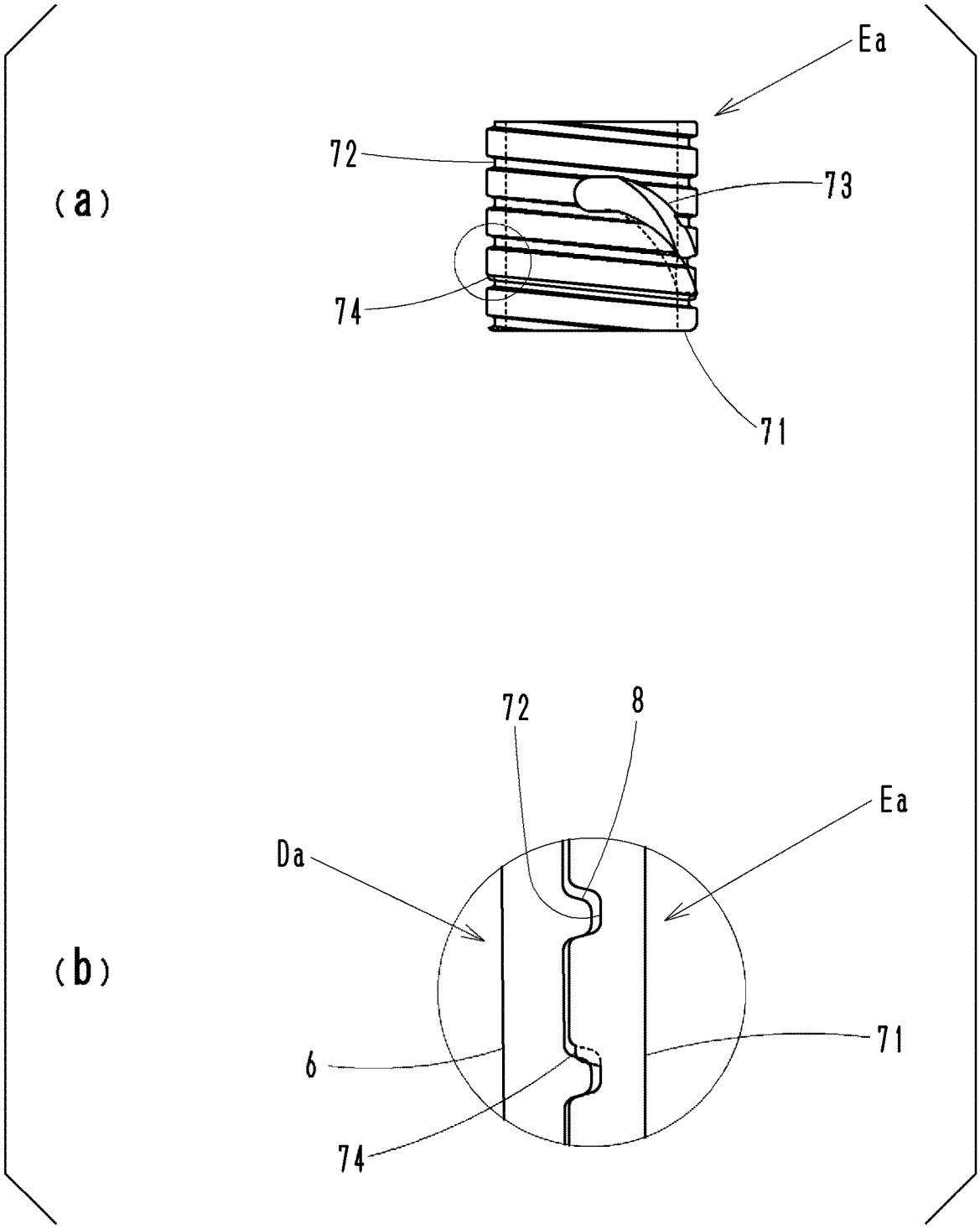
FIG. 12 is a view showing the outer cylindrical body and the inner cylindrical body according to the second embodiment, in which (a) is a front view of the inner cylindrical body and (b) is an enlarged cross-sectional view of the inner cylindrical body to be screwed into the outer cylindrical body.

As shown in (a) and (b) of FIG. 12, an interfering projection 74 is formed in the screw groove portion 72 spirally provided on the outer circumferential surface of the main body portion 71 along an upper surface of the screw groove portion 72 by one round from the lower end portion of the main body portion 71 to increase an operation resistance when the screw thread portion 8 of the outer cylindrical body Da is screwed into the screw groove portion 72. That is, the interfering projection 74 is an interfering projection which protrudes downward from the upper surface of the screw groove portion 72 and extends along the upper surface of the screw groove portion 72 by one round starting from the lower end portion of the main body portion 71. Although the interfering projection 74 in the present embodiment is formed along the upper surface of the screw groove portion 72, the present invention is not limited thereto. The interfering projection 74 may be formed in any portion of the screw groove portion 72, or may be formed, for example, along a bottom surface of the screw groove portion 72 as shown in (a) and (b) of FIG. 13. That is, the interfering projection 74 may be an interfering projection which protrudes radially outward of the main body portion 71 from the bottom surface of the screw groove portion 72 and extends along the bottom surface of the screw groove portion 72 by one round of the screw groove portion 72 from the lower end portion of the main body portion 71. In addition, the interfering projection 74 may be alternately provided on the upper surface and the lower surface of the screw groove portion 72. That is, the interfering projection 74 may be an interfering projection which includes a first interfering projection protruding downward from the upper surface of the screw groove portion 72; and a second interfering projection protruding upward from the lower surface of the screw groove portion 72 and in which the first interfering projection and the second interfering projection are alternately provided on the upper surface and the lower surface of the screw groove portion 72 by one round of the screw groove portion 72 starting from the lower end portion of the main body portion 71.

Furthermore, the interfering projection 74 in the present embodiment is provided by one round of the screw groove portion 72 starting from the lower end portion of the main body portion 71. This is because the screw thread portion 8 of the outer cylindrical body Da is not spirally provided up to an upper end of the inner circumferential surface of the outer circumferential wall 6 as shown in (a) of FIG. 11 when the inner cylindrical body Ea moves up along the inner circumferential surface of the outer cylindrical body Da. This is because reduction in the number of turns of the screw thread portion 8 to be spirally provided facilitates production of the outer cylindrical body Da when molding the outer cylindrical body. However, in a case where the screw thread portion 8 of the outer cylindrical body Da is spirally provided up to the upper end of the inner circumferential surface of the outer circumferential wall 6, the interfering projection 74 may be formed in any portion of the entire length of the screw groove portion 72. In addition, the interfering projection 74 is not necessarily formed continuously along the screw groove portion 72, and may be formed intermittently.

As shown in FIG. 10, the middle cylindrical body F is rotatably provided with respect to the inner cylindrical body Ea in a state of being prevented from being slipped into the seal cylinder 61 using a locking protrusion 34 of an intermediate portion. The intermediate portion is positioned substantially in the middle of the middle cylindrical body F in the axial direction. The middle cylindrical body F includes: a storage cylinder portion 31 positioned at an upper portion of the locking protrusion 34 of the intermediate portion; and a guide cylinder portion 32 positioned at a lower portion of the locking protrusion 34. Two slit portions 33 which extend in the axial direction and are opposed to each other are formed in the guide cylinder portion 32. The two slit portions 33 are opposed to each other in the radial direction of the guide cylinder portion 32.

As shown in FIG. 10, the middle plate body G includes: a cylindrical plate side wall 41 which is positioned at an upper portion and in which the lipstick k is stored; a ring-shaped plate bottom wall 42 which is formed inward from a lower end portion of the plate side wall 41 and of which a central portion is open; a plurality of storage ribs 43 which are provided protruding in the radial direction from the inner circumferential surface of the plate side wall 41 in order to hold a lower portion of the lipstick k with the middle plate body G, and extend in the axial direction; and a cylindrical guide cylinder wall 44 which is suspended from a lower end portion of the plate side wall 41 and of which an outer circumferential surface comes into slidable contact with an inner circumferential surface of the guide cylinder portion 32 of the middle cylindrical body F. Furthermore, two screw pins 45 which penetrate the slit portions 33 formed in the guide cylinder portion 32 of the middle cylindrical body F and are screwed into the spiral groove 73 of the inner cylindrical body Ea are provided protruding on an outer circumferential surface of a lower end portion of the guide cylinder wall 44.

In addition, in order to prevent volatile components contained in the lipstick k stored in the middle plate body G from volatilizing and to prevent entry of abrasion powder, dust, or the like, an inner cover 50 is mounted on an upper end portion of the storage cylinder portion 31 of the middle cylindrical body F as shown in FIG. 10. As shown in FIG. 10, the cap C includes: a disk-shaped top wall 51 having a swelling toward the center from the periphery; and a disk-shaped side circumferential wall 52 suspended from an outer edge of the top wall 51. The side circumferential wall 52 fits into the mounting cylinder 60 so that an inner circumferential surface of the side circumferential wall comes into contact with an outer circumferential surface of the mounting cylinder 60. The top wall 51 swells upward.

Figure 13:
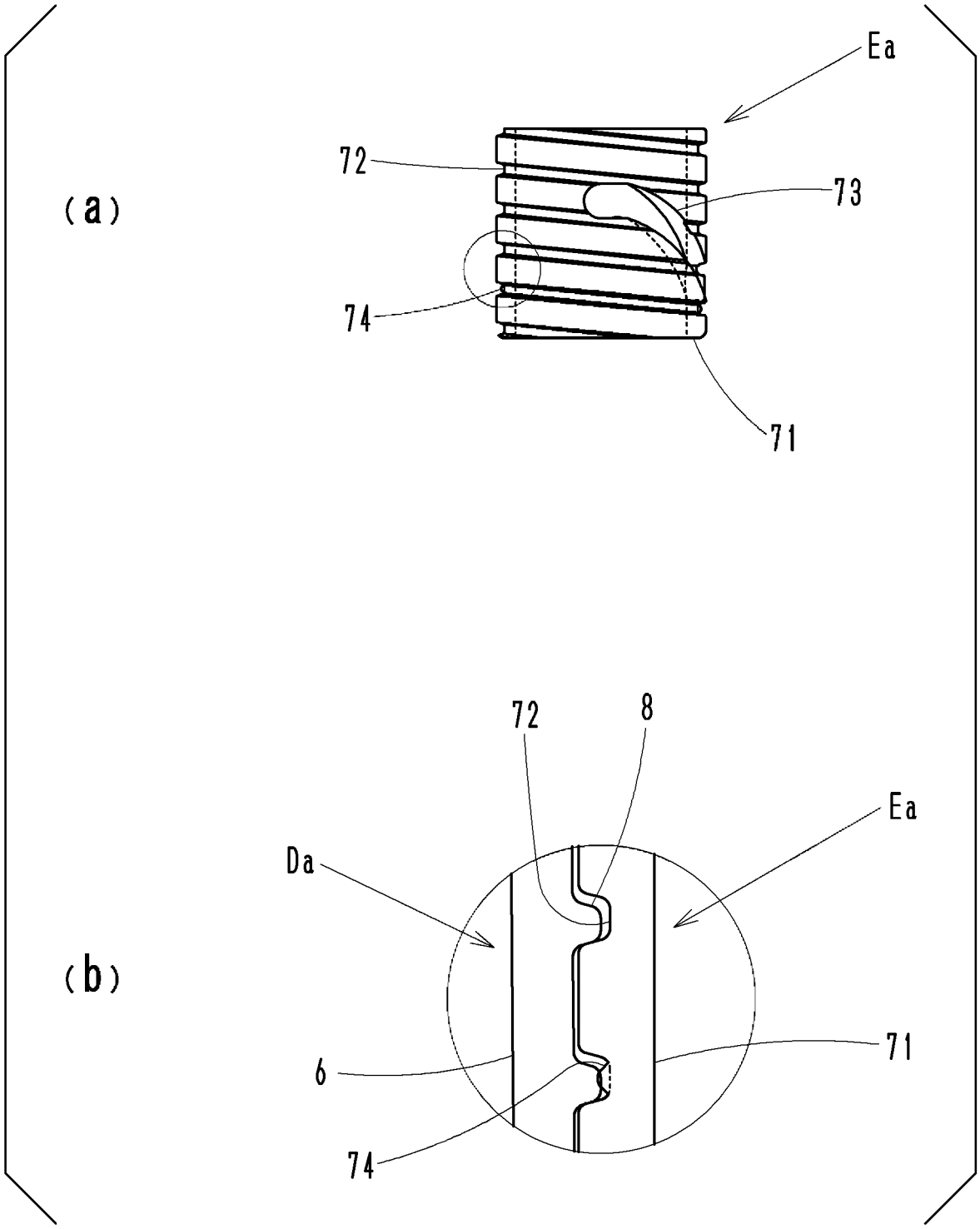
FIG. 13 is a view showing the outer cylindrical body and the inner cylindrical body according to the second embodiment, in which (a) is a front view of the inner cylindrical body and (b) is an enlarged cross-sectional view of the inner cylindrical body to be screwed into the outer cylindrical body.

Next, a method of use and effects of the present embodiment will be described with reference to the drawings. When using the lipstick k, the cap C is removed from the container main body B of the lipstick container A shown in FIG. 10. In a case where the outer circumferential wall 6 of the outer cylindrical body Da is rotated clockwise with respect to the middle cylindrical body F (when the outer cylindrical body D is seen from below in the axial direction) while gripping the storage cylinder portion 31 of the middle cylindrical body F with fingers after the inner cover 50 is removed from the middle cylindrical body F, the operation resistance when the screw thread portion 8 of the outer cylindrical body Da is screwed into the screw groove portion 72 of the inner cylindrical body Ea can be made reliably larger than an operation resistance when the screw pins 45 of the middle plate body G are screwed into the spiral groove 73 of the inner cylindrical body Ea because the interfering projection 74 is formed in the screw groove portion 72 of the inner cylindrical body Ea as shown in FIGS. 12 and 13. Accordingly, the inner cylindrical body Ea rotates integrally with the outer cylindrical body Da at the start of use.

Figure 17:
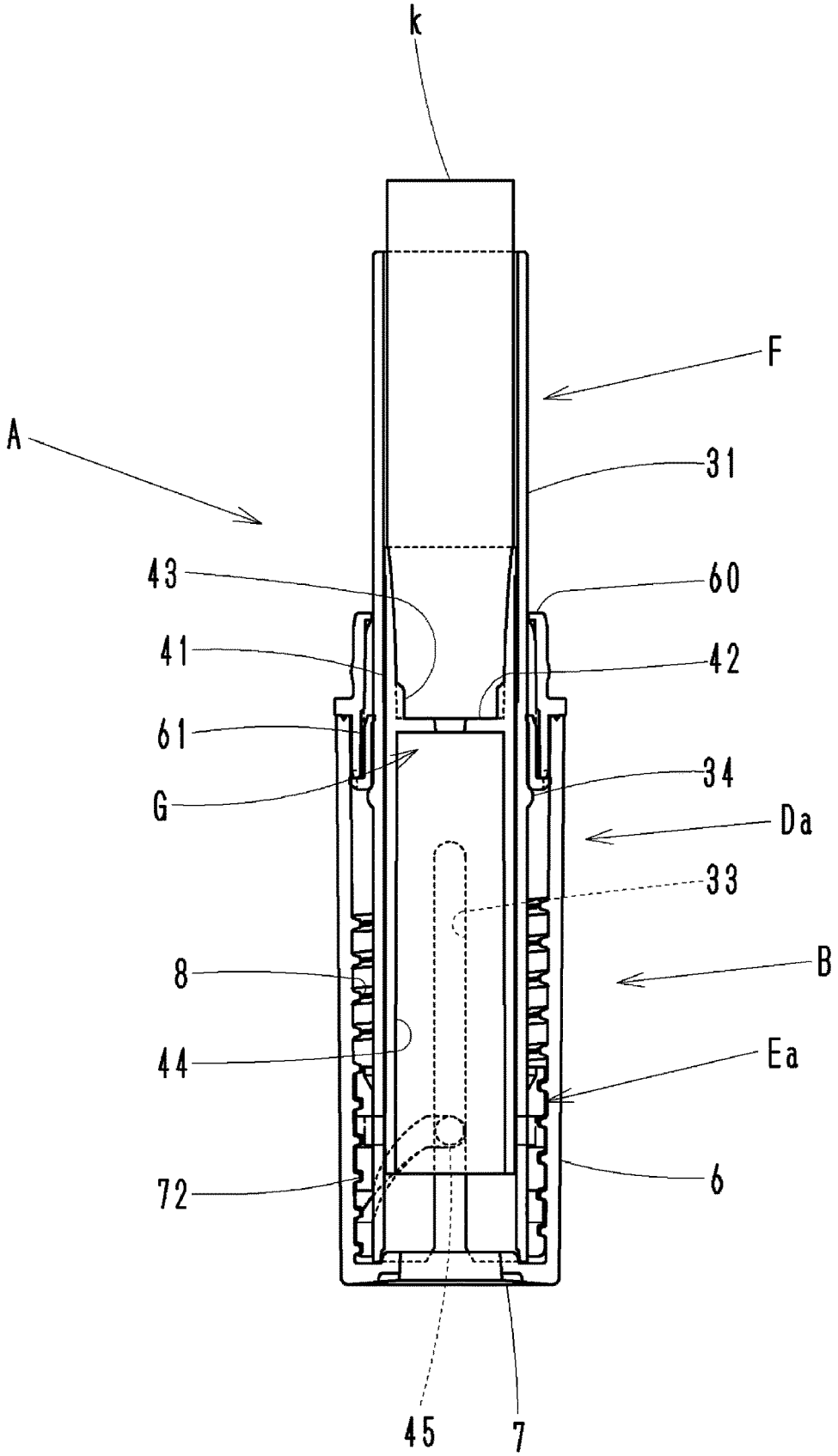
FIG. 17 is a cross-sectional side view showing the lipstick container according to the second embodiment when lipstick has been dispensed to a fixed position.

Furthermore, in the case where the inner cylindrical body Ea rotates integrally with the outer cylindrical body Da, the screw pins 45 screwed into the spiral groove 73 of the inner cylindrical body Ea starts to move up along the slit portions 33 of the middle cylindrical body F and the middle plate body G also starts to move up. Then, the screw pins 45 of the middle plate body G move up to the horizontal portion 73*b* continuing from the inclination portion 73*a* of the spiral groove 73 accompanied by the rotation of the inner cylindrical body Ea. Accordingly, the middle plate body G stops the moving up at the fixed position, a distal portion of the lipstick k protrudes from the storage cylinder portion 31 of the middle cylindrical body F as shown in FIG. 17, and the lipstick k can be used.

As described above, in the present embodiment, the interfering projection 74 is formed in the screw groove portion 72 of the inner cylindrical body Ea. For this reason, the operation resistance when the screw thread portion 8 of the outer cylindrical body Da is screwed into the screw groove portion 72 of the inner cylindrical body Ea can be made stably larger than the operation resistance when the screw pins 45 of the middle plate body G are screwed into the spiral groove 73 of the inner cylindrical body Ea. The form or size of the interfering projection 74 formed in the screw groove portion 72 of the inner cylindrical body Ea can be appropriately set according to the size of a required operation resistance.

Modification Example

Next, a modification example 1 of the second embodiment according to the present invention will be described with reference to FIGS. 14 to 16. An inner cylindrical body Ea provided with a thin valve actuator 76 of which upper and lower ends are separated from each other due to a gap s1 along the screw groove portion 72 and an interfering projection 77 formed in a center portion of the valve actuator 76 as shown in (a) to (c) of FIG. 14 instead of the interfering projection 74 formed in the screw groove portion 72 of the inner cylindrical body Ea will be described as the modification example of the second embodiment. That is, the main body portion 71 includes the gap s1 extending along the screw groove portion 72. The thin valve actuator 76 is formed so that its upper and lower ends are separated from an upper surface and a lower surface which form the gap s1 of the main body portion 71, and extends in the direction in which the screw groove portion 72 extends. The interfering projection 77 protrudes radially outward of the valve actuator 76 in the center portion of the valve actuator 76 in the direction in which the screw groove portion 72 extends. The valve actuator 76 in the present modification example is formed in a lateral direction along the screw groove portion 72, but the present invention is not limited thereto. The valve actuator may be a valve actuator 78 formed in a longitudinal direction while intersecting with the screw groove portion 72 as shown in (a) to (c) of FIG. 15. In this case, left and right ends of the thin valve actuator 78 are separated from each other by a gap s2 along the longitudinal direction intersecting with the screw groove portion 72, and an interfering projection 79 is formed at a position intersecting with the screw groove portion 72 of the valve actuator 78. That is, the main body portion 71 includes the gap s2 extending along the longitudinal direction intersecting with the screw groove portion 72. The thin valve actuator 78 is formed so that the left and right ends are separated from two surfaces which form the gap s2 of the main body portion 71 and opposed to each other in the circumferential direction, and extends in the longitudinal direction intersecting with the screw groove portion 72. The interfering projection 79 is formed at a position intersecting with the screw groove portion 72 of the valve actuator 78.

Figure 14:
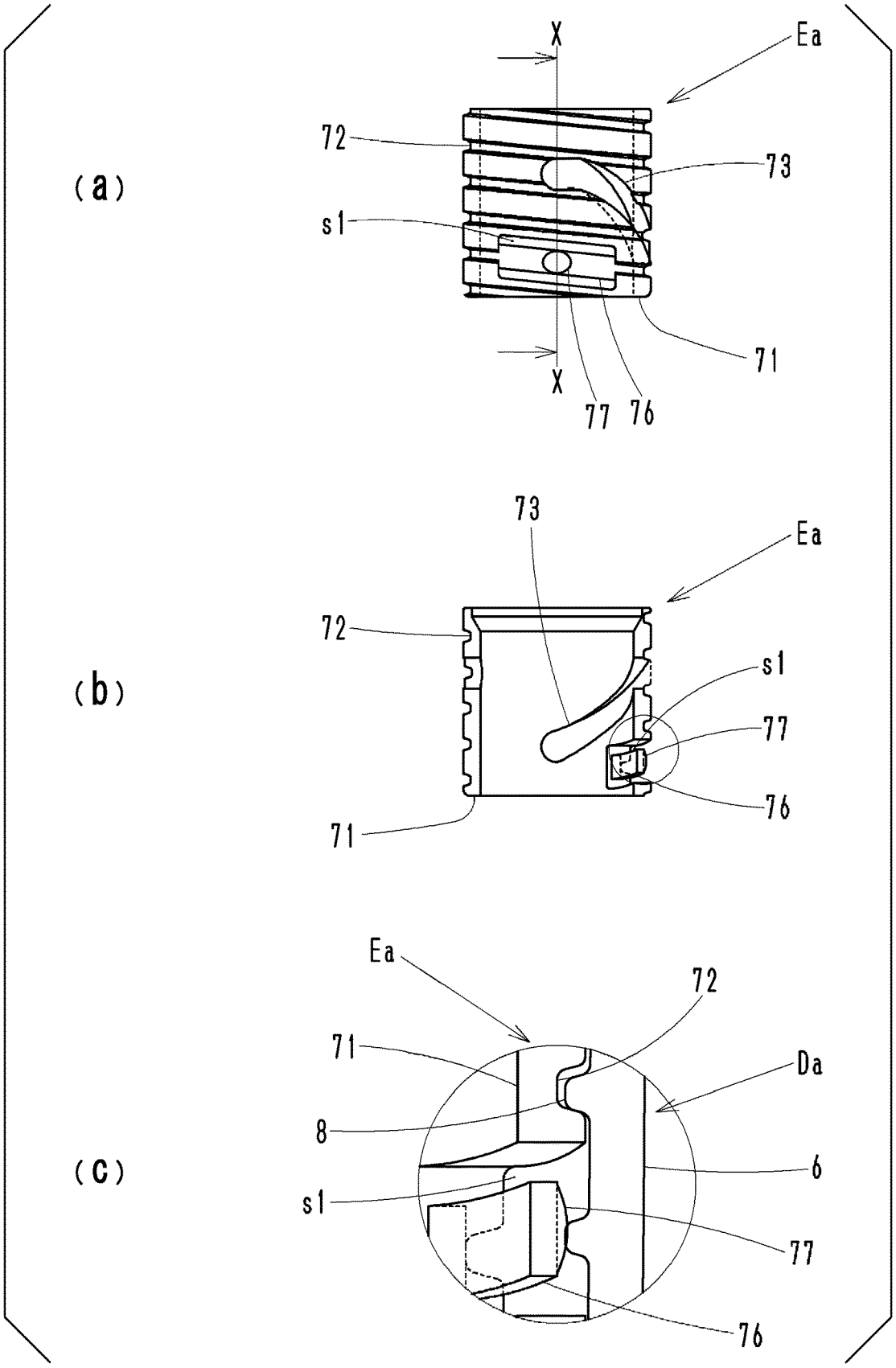
FIG. 14 is a view showing an outer cylindrical body and an inner cylindrical body of a modification example of the second embodiment, in which (a) is a front view of the inner cylindrical body, (b) is a cross-sectional arrow view taken along X-X of (a), and (c) is an enlarged cross-sectional view of the inner cylindrical body to be screwed into the outer cylindrical body.
Figure 15:
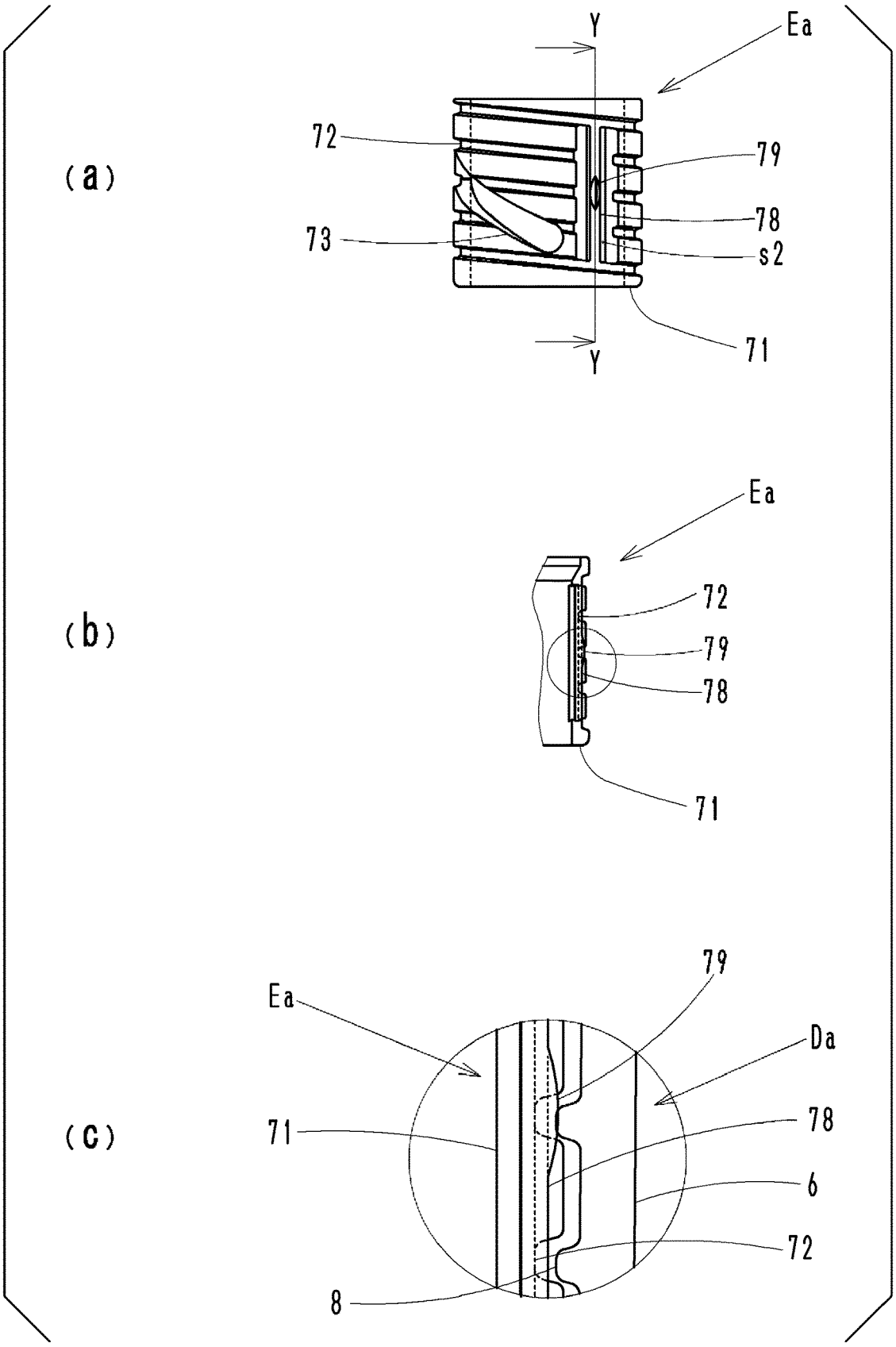
FIG. 15 is a view showing an outer cylindrical body and an inner cylindrical body of a modification example of the second embodiment, in which (a) is a front view of the inner cylindrical body, (b) is a cross-sectional arrow view taken along Y-Y of (a), and (c) is an enlarged cross-sectional view of the inner cylindrical body to be screwed into the outer cylindrical body.
Figure 16:
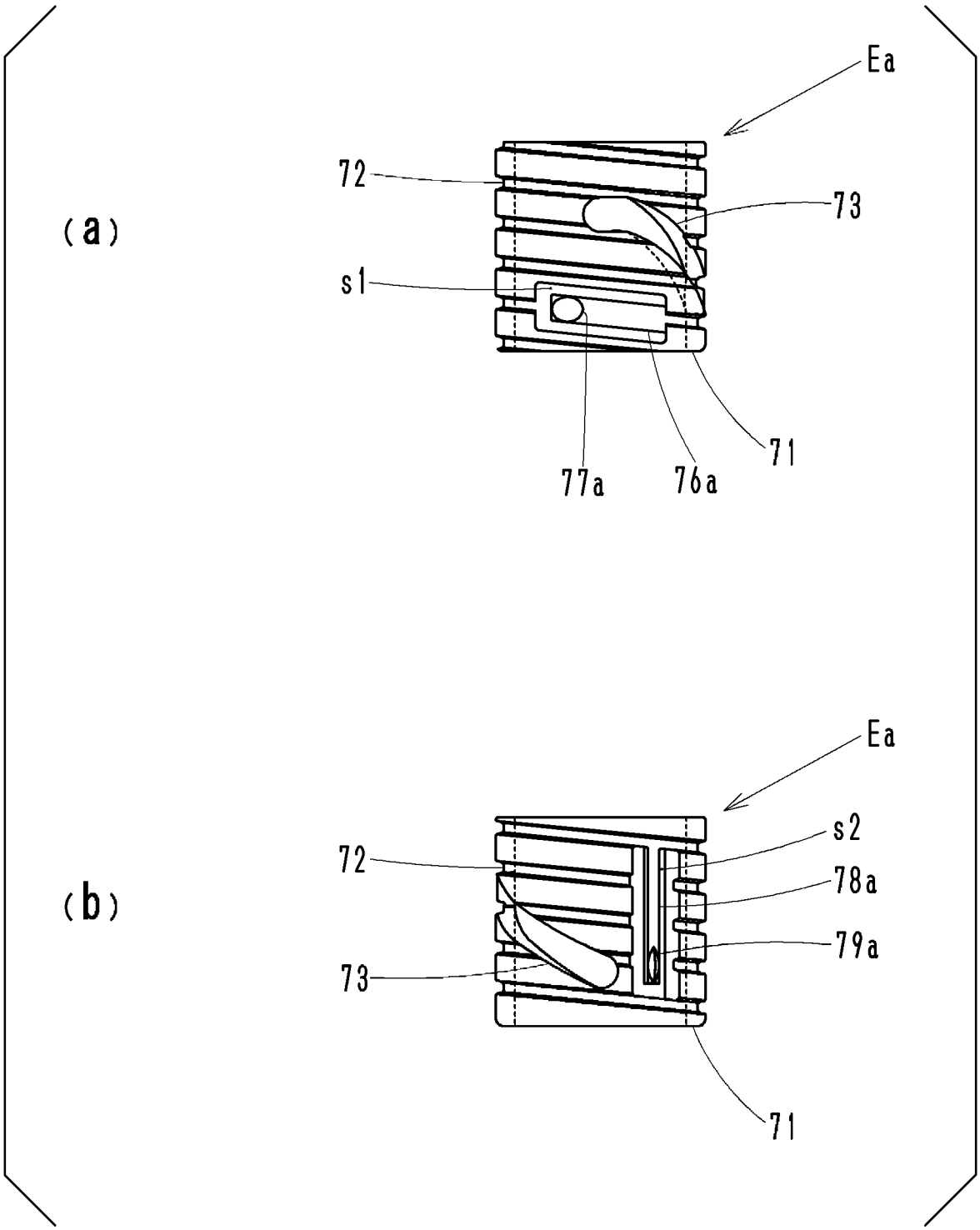
FIG. 16 is a view showing an inner cylindrical body of a modification example of the second embodiment, in which (a) is a front view of the inner cylindrical body obtained by modifying (a) of FIG. 14 and (b) is a front view of an inner cylindrical body obtained by modifying (a) of FIG. 15.

Both ends of the valve actuators 76 and 78 shown in (a) to (c) of FIG. 14 and (a) to (c) of FIG. 15 are connected to the main body portion 71. That is, both ends of the valve actuator 76 in a direction in which the screw groove portion 72 extends are connected to the main body portion 71, and both ends of the valve actuator 78 in a longitudinal direction intersecting with the screw groove portion 72 are connected to the main body portion 71. However, as shown in (a) and (b) of FIG. 16, the valve actuator may be valve actuators 76*a* and 78*a* which have a cantilever structure and of which only one side is connected to the main body portion 71 and the other side is separated from the main body portion by the gap s1 or s2. That is, the valve actuator may be the valve actuator 76*a* of which one end out of both ends in the direction in which the screw groove portion 72 extends is connected to the main body portion 71 and the other end is not connected to the main body portion 71 while being separated by the gap s1 as shown in (a) of FIG. 16, or may be the valve actuator 78*a* of which one end out of both ends in the longitudinal direction intersecting with the screw groove portion 72 is connected to the main body portion 71 and the other end is not connected to the main body portion 71 while being separated by the gap s2 as shown in (b) of FIG. 16. The operation resistance can be stabilized as long as the valve actuators 76, 76*a*, 78, and 78*a* are formed in at least one place of the inner cylindrical body Ea. However, it is more preferable that a plurality of valve actuators be formed at positions opposite to each other on the periphery of the inner cylindrical body Ea. That is, a plurality of valve actuators 76 and 76*a* extending in the direction in which the screw groove portion 72 extends are preferably formed on the outer circumferential surface of the inner cylindrical body Ea at positions opposite to each other in the direction in which the screw groove portion 72 extends, and a plurality of valve actuators 78 and 78*a* extending in the longitudinal direction intersecting with the screw groove portion 72 are preferably formed on the outer circumferential surface of the inner cylindrical body Ea at positions opposite to each other in the radial direction. In addition, interfering projections 77, 77*a*, 79, and 79*a* respectively supported by the valve actuators 76, 76*a*, 78, and 78*a* are formed in the inner cylindrical body Ea instead of the interfering projection 74 in the present modification example. However, the interfering projection 74 may be used in combination with the interfering projections 77, 77*a*, 79, and 79*a* supported by the valve actuators 76, 76*a*, 78, and 78*a*.

Next, a method of use and effects of the present modification example will be described with reference to the drawings. Regarding the operation resistance when the screw thread portion 8 of the outer cylindrical body Da is screwed into the screw groove portion 72 of the inner cylindrical body Ea, since the thin valve actuators 76, 76*a*, 78, and 78*a* respectively having the interfering projections 77, 77*a*, 79, and 79*a* are formed in the screw groove portion 72 of the inner cylindrical body Ea as shown in FIGS. 14 to 16, if the screw thread portion 8 of the outer cylindrical body Da abuts on the interfering projections 77, 77*a*, 79, and 79*a*, the interfering projections 77, 77*a*, 79, and 79*a* are pressed in the radial direction due to elastic deformation of the valve actuators 76, 76*a*, 78, and 78*a*. Accordingly, a moderate operation resistance can be given when the screw thread portion 8 of the outer cylindrical body Da is screwed into the screw groove portion 72 of the inner cylindrical body Ea.

Even if there are dimensional errors in the screw thread portion 8 of the outer cylindrical body Da and the screw groove portion 72 of the inner cylindrical body Ea in the present modification example, since the interfering projections 77, 77*a*, 79, and 79*a* that impart an operation resistance are respectively supported by the elastically deformable valve actuators 76, 76*a*, 78, and 78*a* as described above, the interfering projections can be made to appear in the radial direction. Accordingly, when the screw thread portion 8 of the outer cylindrical body Da is screwed into the screw groove portion 72 of the inner cylindrical body Ea, both the portions can be smoothly screwed with each other while imparting a moderate operation resistance.

As described above, although the embodiments of the present invention and the modification example have been described with reference to the drawings, the present invention is not limited to the above-described embodiments and modification example.

Figure 18:
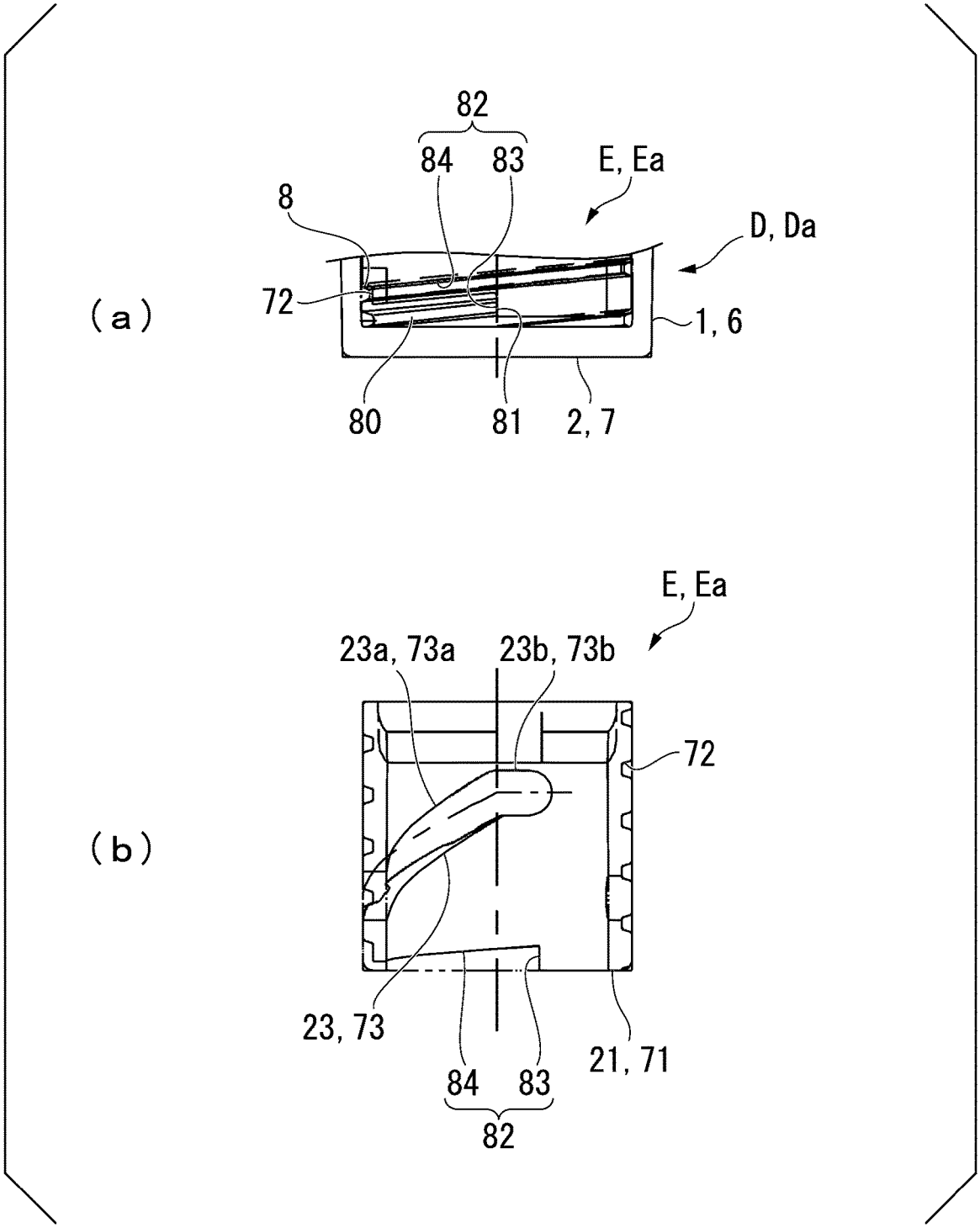
FIG. 18 is a view showing an inner cylindrical body and an outer cylindrical body of another modification example of the first embodiment and the second embodiment, in which (a) is a cross-sectional front view showing a state when the inner cylindrical body is moved down to a fixed position with respect to the outer cylindrical body and (b) is a cross-sectional front view of the inner cylindrical body.

The lipstick container of the present invention may include an engagement portion provided in the outer cylindrical bodies D and Da, and a portion to be engaged which is provided in the inner cylindrical bodies E and Ea and engageable with the engagement portion, and may include a stopper device that restricts relative rotation between the outer cylindrical bodies D and Da and the inner cylindrical bodies E and Ea by engaging the engagement portion with the portion to be engaged. For example, the engagement portion may be a rib 80 provided at lower end portions on the inner circumferential surfaces of the outer circumferential walls 1 and 6 of the outer cylindrical bodies D and Da as shown in (a) of FIG. 18, and the portion to be engaged may be a step portion 82 which is engageable with the rib 80 and provided at lower end portions on the outer circumferential surfaces of the main body portions 21 and 71 of the inner cylindrical bodies E and Ea as shown in (a) and (b) of FIG. 18.

More specifically, the rib 80 is a projection which is formed near one end portion (lower end portion) positioned on a lower side of both end portions in a spiral direction of the screw thread portion 8 and protrudes radially inward from the inner circumferential surface of the outer circumferential wall 6. The spiral direction of the screw thread portion 8 means a direction along the spiral shape of the screw thread portion 8 itself. The rib 80 is a projection extending along the spiral direction of the screw thread portion 8 as shown in (a) of FIG. 18. Although the projection such as the rib 80 has been described as an example, a projection having another shape may be provided instead of the rib 80. The shape of the projection is not limited as long as the projection can abut on a side surface 83 of the step portion 82 by moving down the inner cylindrical bodies E and Ea as will be described below. For this reason, a projection which does not extend along the spiral direction of the screw thread portion 8 may be provided instead of the rib 80.

The step portion 82 is a notch formed by notching the main body portion 71 of the inner cylindrical bodies E and Ea upward from a lower end surface of the main body portion so as to be recessed. The step portion 82 includes: the side surface 83 facing a direction in which the inner cylindrical bodies E and Ea rotate to move down; and an upper surface 84 which extends along the spiral direction of the screw groove portion 72 from an upper end of the side surface 83 and faces downward. The spiral direction of the screw groove portion 72 means a direction along the spiral shape of the screw groove portion 72 itself. The step portion 82 is a notch having the shape shown in (a) and (b) of FIG. 18. Although the notch such as step portion 82 has been described as an example, a notch having another shape may be provided instead of the step portion 82. The shape of the notch is not limited as long as the notch includes a side surface that can abut on the rib 80 by moving down the inner cylindrical bodies E and Ea as will be described below. For this reason, a notch having a shape recessed radially inward from the outer circumferential surfaces of the main body portions 21 and 71 without penetrating the main body portions 21 and 71 of the inner cylindrical bodies E and Ea in the radial direction may be provided instead of the step portion 82.

According to the outer cylindrical bodies D and Da including such a rib 80 (projection, engagement portion) and the inner cylindrical bodies E and Ea including such a step portion 82 (notch, portion to be engaged), the side surface 83 forming the step portion 82 can be made to be gradually close to and abut on one end (upper end) 81 positioned on an upper side of both ends of the rib 80 in the direction along the extending rib 80 by moving down the inner cylindrical bodies E and Ea with respect to the outer cylindrical bodies D and Da. Accordingly, the rib 80 (projection, engagement portion) of the outer cylindrical bodies D and Da can be engaged with the step portion 82 (notch, portion to be engaged) of the inner cylindrical bodies E and Ea, and therefore, relative rotation between the outer cylindrical bodies D and Da and the inner cylindrical bodies E and Ea can be restricted. Furthermore, the rib 80 (projection, engagement portion) is formed near the one end portion (lower end portion) positioned on the lower side of both end portions in the spiral direction of the screw thread portion 8.

Accordingly, it is possible to stop the moving down of the inner cylindrical bodies E and Ea at a position at which the main body portions 21 and 71 of the inner cylindrical bodies E and Ea and the bottom walls 2 and 7 of the outer cylindrical bodies D and Da are separated from each other by a predetermined distance in the axial direction. As a result, when the inner cylindrical bodies E and Ea next move up with respect to the outer cylindrical bodies D and Da, the inner cylindrical bodies E and Ea move up in a state where the main body portions 21 and 71 of the inner cylindrical bodies E and Ea and the bottom walls 2 and 7 of the outer cylindrical bodies D and Da are separated from each other by a predetermined distance in the axial direction, and therefore, it is possible to prevent the inner cylindrical bodies E and Ea from hardly moving up with respect to the outer cylindrical bodies D and Da due to surface contact between the main body portions 21 and 71 of the inner cylindrical bodies E and Ea and the bottom walls 2 and 7 of the outer cylindrical bodies D and Da. The predetermined distance described above is appropriately set by adjusting the position of the rib 80 (projection, engagement portion) of the outer cylindrical bodies D and Da in the axial direction in consideration of various conditions.

Various shapes, combinations, or the like of the constituent members shown in the above-described embodiments and modification example are merely examples, and can be variously modified based on design requirements and the like within the scope not departing from the gist of the present invention. For example, the constituent elements shown in the above-described embodiments and modification example may be appropriately combined within the scope not departing from the gist of the present invention.

INDUSTRIAL APPLICABILITY

The lipstick container of the present invention can prevent lipstick from being broken by a user accidentally taking too much of the lipstick out at the start of use, and therefore, can be suitably used as a lipstick container in which soft lipstick is stored.

REFERENCE SIGNS LIST

A Lipstick container
B Container main body
C Cap
D, Da Outer cylindrical body
E, Ea Inner cylindrical body
F Middle cylindrical body
G Middle plate body
k Lipstick
s1, s2 Gap
1, 6 Outer circumferential wall
2, 7 Bottom wall
3 Female screw portion
8 Screw thread portion
10, 60 Mounting cylinder
11 Insertion cylinder portion
12 Flange portion
13 Cap-mounting portion
14 Annular protrusion
16, 61 Seal cylinder
21, 71 Main body portion
22 Male screw portion (screw portion)
23, 73 Spiral groove
23*a*, 73*a* Inclination portion
23*b*, 73*b* Horizontal portion (Planar portion)
24 Diameter-reduced upper portion
31 Storage cylinder portion
32 Guide cylinder portion
33 Slit portion
34 Locking protrusion
41 Plate side wall
42 Plate bottom wall
43 Storage rib
44 Guide cylinder wall
45 Screw pin
50 Inner cover
51 Top wall
52 Side circumferential wall
72 Screw groove portion (screw portion)
74, 77, 77*a*, 79, 79*a* Interfering projection
76, 76*a*, 78, 78*a* Valve actuator
80 Rib (projection, engaging portion)
81 Upper end
82 Step portion (notch, portion to be engaged)
83 Side surface
84 Upper surface

The invention claimed is:

1. A lipstick container, comprising:
a container main body; and
a cap mounted on the container main body,
wherein the container main body includes
a middle plate body in which lipstick is stored and is provided with a screw pin,
a middle cylindrical body which guides the middle plate body such that the middle plate body can move vertically but cannot rotate,
an inner cylindrical body in which a spiral groove into which the screw pin of the middle plate body is screwed is formed, and which vertically moves the middle plate body by rotating on an outer circumference of the middle cylindrical body, and
an outer cylindrical body, an inner circumferential surface of which is screwed into an outer circumferential surface of the inner cylindrical body, and
wherein one of the middle plate body and the inner cylindrical body moves up to a fixed position through rotation of the outer cylindrical body, and once the one reaches the fixed position, the other of the middle plate body and the inner cylindrical body is moved up through rotation of the outer cylindrical body.

2. The lipstick container according to claim 1,
wherein an operation resistance when the inner cylindrical body is screwed into the outer cylindrical body is larger than an operation resistance when the screw pin of the middle plate body is screwed into the spiral groove of the inner cylindrical body.

3. The lipstick container according to claim 2,
wherein the inner cylindrical body includes a screw portion screwed into the outer cylindrical body, and
wherein an interfering projection is formed in the screw portion.

4. The lipstick container according to claim 3,
wherein a plurality of the interfering projections are formed intermittently along the screw portion.

5. The lipstick container according to claim 3,
wherein the interfering projection is formed in a valve actuator elastically deformable in a radial direction.

6. The lipstick container according to claim 1,
wherein an operation resistance when the inner cylindrical body is screwed into the outer cylindrical body is smaller than an operation resistance when the screw pin of the middle plate body is screwed into the spiral groove of the inner cylindrical body.

7. The lipstick container according to claim 1, wherein the inner cylindrical body includes a screw portion screwed into the outer cylindrical body, and wherein a pitch of the spiral groove is larger than that of the screw portion.

8. The lipstick container according to claim 7, wherein an interfering projection is formed in the screw portion.

9. The lipstick container according to claim 8, wherein a plurality of the interfering projections are formed intermittently along the screw portion.

10. The lipstick container according to claim 1, wherein the inner cylindrical body includes a screw portion screwed into the outer cylindrical body, and wherein a pitch of the spiral groove is smaller than that of the screw portion.

11. The lipstick container according to claim 1, wherein the inner cylindrical body has a planar portion provided at an upper end portion of the spiral groove, the planar portion along a direction orthogonal to a direction along a central axis of the inner cylindrical body.

12. The lipstick container according to claim 11, wherein the inner cylindrical body includes a screw portion screwed into the outer cylindrical body, and wherein an interfering projection is formed in the screw portion.

* * * * *